US010577788B1

(12) United States Patent
Zail

(10) Patent No.: US 10,577,788 B1
(45) Date of Patent: Mar. 3, 2020

(54) RECONFIGURABLE LIVING SPACE

(71) Applicant: Impact Urban, LLC, Mill Valley, CA (US)

(72) Inventor: Nolan Zail, Mill Valley, CA (US)

(73) Assignee: Impact Urban, LLC, Mill Valley, CA (US)

( * ) Notice: Subject to any disclaimer, the term of this patent is extended or adjusted under 35 U.S.C. 154(b) by 0 days.

(21) Appl. No.: 16/246,219

(22) Filed: Jan. 11, 2019

(51) Int. Cl.

| | |
|---|---|
| ***E04B 1/343*** | (2006.01) |
| ***E04B 1/35*** | (2006.01) |
| ***E04B 2/82*** | (2006.01) |
| ***E04H 1/00*** | (2006.01) |
| *E04B 2/74* | (2006.01) |

(52) U.S. Cl.
CPC ..... *E04B 1/343* (2013.01); *E04B 1/35* (2013.01); *E04B 2/827* (2013.01); *E04H 1/005* (2013.01); *E04B 2002/7483* (2013.01)

(58) Field of Classification Search
CPC . E04B 1/343; E04B 2/827; E04B 1/35; E04B 2002/7483; E04H 1/005
See application file for complete search history.

(56) References Cited

U.S. PATENT DOCUMENTS

| | | | | |
|---|---|---|---|---|
| 3,042,978 | A | 7/1962 | Eames et al. | |
| 3,141,207 | A | 7/1964 | Kahler | |
| 3,226,778 | A * | 1/1966 | Kollsman | E04B 2/827 49/130 |
| 5,601,348 | A | 2/1997 | Minkovski | |
| 6,128,875 | A | 10/2000 | Quaintance | |
| 6,405,491 | B1 * | 6/2002 | Gallant | E04B 2/74 52/220.1 |
| 7,454,868 | B2 | 11/2008 | Clark | |
| 9,084,489 | B2 | 7/2015 | Gosling et al. | |
| 9,222,255 | B2 * | 12/2015 | Johnson | E04B 2/827 |
| 9,382,749 | B2 * | 7/2016 | George | E05D 15/0626 |
| 2005/0086876 | A1 * | 4/2005 | Clark | E04B 2/827 52/79.1 |
| 2012/0318467 | A1 * | 12/2012 | Levin | E04B 2/827 160/194 |
| 2015/0247338 | A1 | 9/2015 | Woodroffe | |
| 2018/0258635 | A1 * | 9/2018 | Birsel | E04B 2/7433 |

* cited by examiner

*Primary Examiner* — Patrick J Maestri

(74) *Attorney, Agent, or Firm* — Vierra Magen Marcus LLP

(57) ABSTRACT

A living space is disclosed including one or more reconfigurable rooms. A room may be made reconfigurable by including a first wall that is configured to expand and retract along its length, and to move in a first direction orthogonally to its length. The room may also be configurable by including a second wall configured to expand and retract along its length, and to move in a second direction orthogonally to its length. The reconfigurable room may further include movable furniture placed in different positions, depending on a configuration of the room.

24 Claims, 23 Drawing Sheets

RECONFIGURABLE LIVING SPACE

BACKGROUND

In densely populated constructions such as dormitories, apartment buildings and hotels, space is at a premium in order to maximize the number of units that can be provided within the construction. Traditionally, this has resulted in units in which both the communal living rooms and bedrooms have a small footprint. Moreover, these units have included fixed walls, where optimizing the size of one room or area comes at the expense of the size of another room or area.

More recently, it has become known to provide internal walls that are capable of moving in one direction to allow the size of a room to be dynamically changed. However, such systems have been complicated and expensive and, as such, not successfully implemented.

DETAILED DESCRIPTION

The present technology will now be described with reference to the figures, which in embodiments, relate to a reconfigurable living space where one or more walls of a room are easily movable in one or more orthogonal directions to provide a high degree of flexibility in the room configuration. Furniture within the room such as a bed and closet may also be easily moved in coordination with the room configuration.

It is understood that the present technology may be embodied in many different forms and should not be construed as being limited to the embodiments set forth herein. Rather, these embodiments are provided so that this disclosure will be thorough and complete and will fully convey the technology to those skilled in the art. Indeed, the technology is intended to cover alternatives, modifications and equivalents of these embodiments, which are included within the scope and spirit of the technology as defined by the appended claims. Furthermore, in the following detailed description of the present technology, numerous specific details are set forth in order to provide a thorough understanding of the present technology. However, it will be clear to those of ordinary skill in the art that the present technology may be practiced without such specific details.

The terms "longitudinal" and "transverse," "top" and "bottom," "upper" and "lower" and "vertical" and "horizontal," and forms thereof, as may be used herein are by way of example and illustrative purposes only, and are not meant to limit the description of the technology inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±2.5% of a given dimension.

Figure 1:
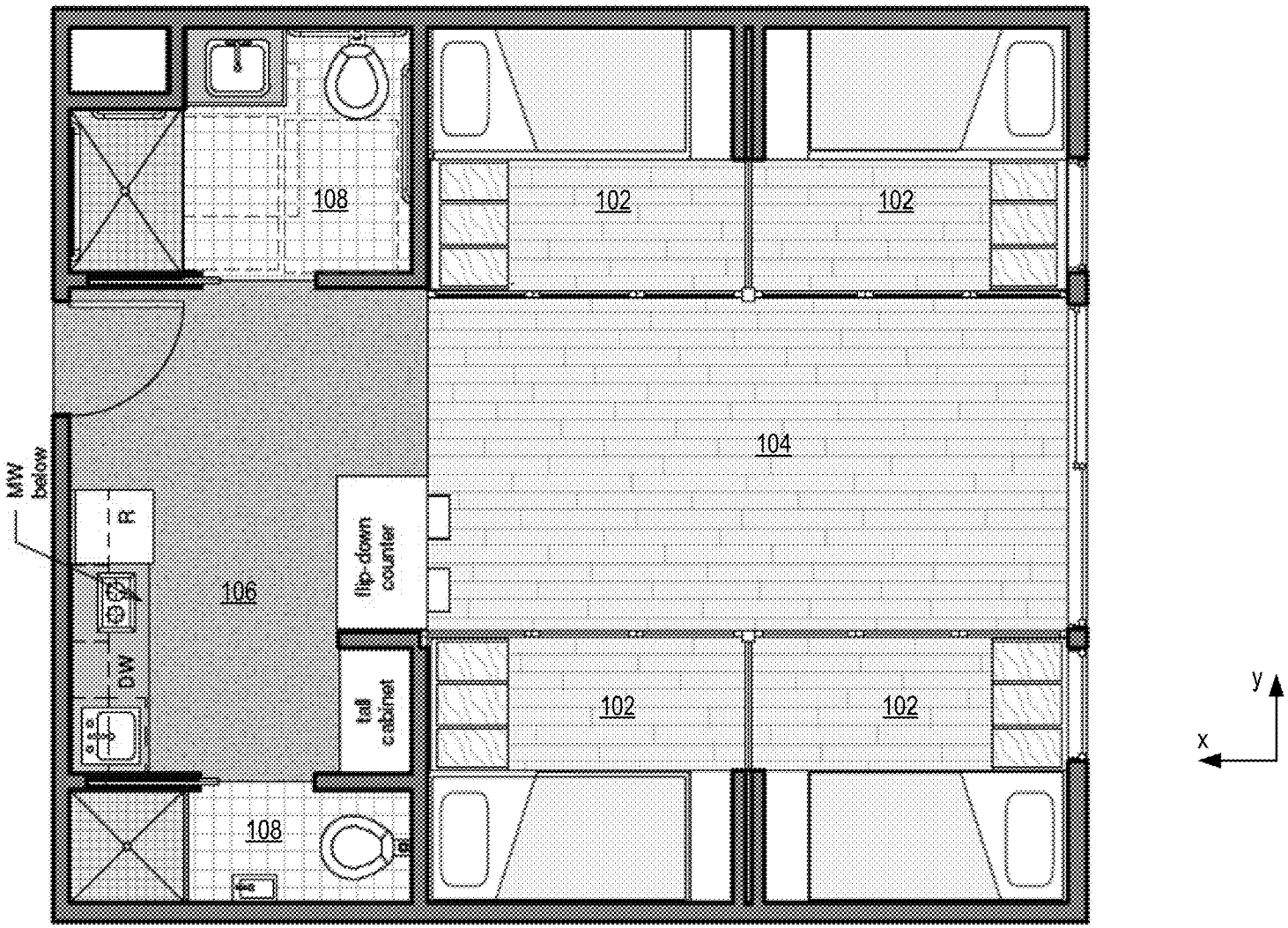
FIG. 1 is a plan view of a living space according to embodiments of the present technology including a number of first rooms such as bedrooms, a communal area, a kitchen and bathrooms.

An embodiment of the present technology will now be explained with reference to the plan and perspective views of FIGS. 1-34. FIG. 1 is a plan view of a living space including one or more rooms that are reconfigurable in accordance with the present technology. In the embodiment shown, the living space 100 includes four rooms 102, a communal area 104, a kitchen 106 and bathrooms 108. It is understood that the living space 100 may have a variety of other configurations in further embodiments, including more or less rooms 102, multiple communal areas 104, more or no kitchens 106 and/or more, one or no bathrooms 108. In one such example, the living space 100 may simply include a room 102 which opens to a communal area 104. The living space 100 may be a single, stand-alone flat, or may be part of a construction including multiple living spaces (such other living spaces being conventional or configured according to the present technology). In embodiments, the living space 100 may be part of an apartment building, a dormitory, a hotel, motel or hostel, an office, a hospital, a library, a showroom, a store or other construction. Such structures may initially be constructed with reconfigurable spaces according to the present technology, or such structures may be modified after their initial construction to include reconfigurable spaces according to the present technology.

In embodiments described below, the room 102 may be a bedroom, but may be any of a variety of other rooms in further embodiments, including a communal area, a kitchen, a bathroom, a den, a living room, a work or other space within an office, or any other type of room found in a construction. The furniture described below within room 102 may be altered depending on the type of room 102.

Figure 2:
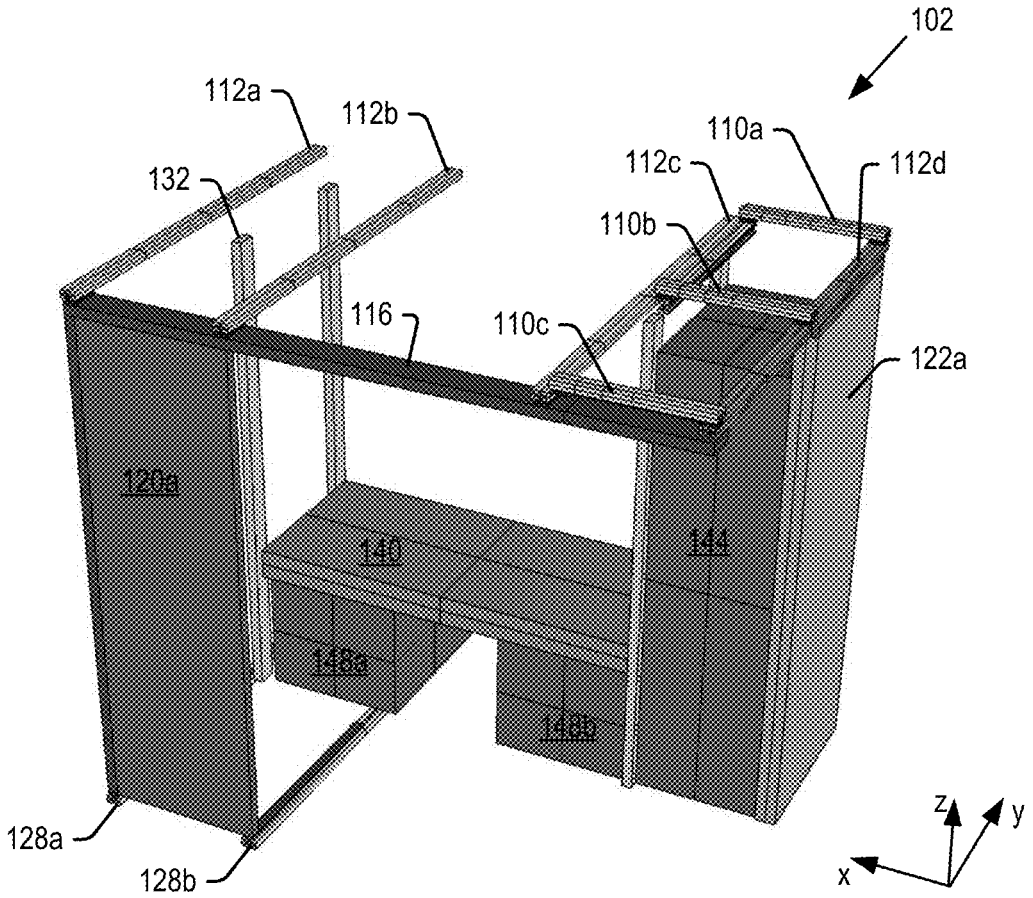
FIGS. 2 and 3 are perspective and plan views of a configuration of a room according to the present technology, expanded longitudinally and transversely, and having open front and side walls panels.

FIG. 2 is a perspective view of one embodiment of a room 102 in accordance with the present technology. In the embodiment shown, the room 102 is expanded in the longitudinal direction (i.e., along the x-axis) and the in the transverse direction (i.e., along the y-axis) to provide a configuration where room 102 has its maximum footprint. As will be explained hereinafter, room 102 may be compacted in one or more of the longitudinal and transverse directions. As will also be explained hereinafter, door panels enclosing the room 102 may be opened or closed to varying degrees in any expanded or compacted configuration.

FIG. 2 shows a ceiling track system comprising longitudinal tracks 110*a*, 110*b*, 110*c* (collectively, longitudinal tracks 110) which affix to supports within or adjacent to a ceiling of living space 100. The track system further includes transverse tracks 112*a*, 112*b*, 112*c* and 112*d* (collectively, transverse tracks 112). In the illustrated embodiment, transverse tracks 112*a*, 112*b* and 112*c* may affix to supports within or adjacent to the ceiling in a living space 100. Transverse track 112*d* in turn are mounted to longitudinal tracks 110 so as to translate along longitudinal tracks 110 as explained hereinafter. FIG. 2 further shows a floor track system comprising transverse tracks 128*a* and 128*b* collectively, transverse tracks 128). It is understood that the number of longitudinal tracks 110, transverse tracks 112 and transverse tracks 128 is shown by way of example only and a room 102 may be configured with more or less of tracks 110, 112 and/or 128. In a further embodiment, instead of being mounted off of the ceiling, tracks 110 and/or 112 may be supported off of a fixed wall such as stationary wall 150.

The tracks 110, 112 and 128 are provided to support wall panels for partially or fully enclosing room 102. In particular, room 102 may include a first set of wall panels 120 for covering a first side of the room, and a second set of wall panels 122 for covering a second side of the room. A room 102 may include various numbers of wall panels 120, 122 (FIG. 2 includes one labeled wall panel 120*a*, and one labeled wall panel 122*a*).

The wall panels 120 may be affixed at their upper end to a frame 116. For example, frame 116 may include tracks on a lower surface (or within) frame 116 to which wall panels 120 are translationally mounted. As explained below, there may be multiple wall panels 120*a*, 120*b*, 120*c*, etc. Each panel 120 may be mounted in distinct planes and on its own track on or within frame 116 so that the panels may retract behind each other (as shown in FIG. 2) or extend to cover the front side of room 102 as explained below.

Frame 116 may in turn be mounted to transverse tracks 112*a*, 112*b* and 112*c* at the ceiling of room 102 to move transversely from an extended position shown in FIG. 2 to a compacted position explained below. One of the panels, e.g., panel 120*a* shown in FIG. 2, may also be mounted at the floor within tracks 128*a* to facilitate transverse movement of the panels 120 with the frame 116 when it moves from the extended position to the compacted position or vice-versa. Floor tracks 128 may be omitted in further embodiments.

The wall panels 122 may be affixed at their upper end to transverse track 112*d* so as to move transversely within the track 112*d*. As explained below, there may be multiple wall panels 122*a* and 120*b* (or more). Each panel 120 may be mounted in distinct planes within track 112*d* so that the panels may retract behind each other (as shown in FIG. 2) or extend to cover the side of room 102 as explained below. Track 112*d* may in turn be mounted to longitudinal tracks 110 at the ceiling of room 102 to move longitudinally from an extended position shown in FIG. 2 to a compacted position explained below.

FIG. 2 further shows a bed 140, cabinet 144 and storage and support containers 148. Each of those may be moved within room 102 depending on the configuration of room 102 as explained below. As noted, one or more of bed 140, cabinet 144 and containers 148 may be swapped out for other furniture or components, depending on the use of room 102.

Figure 3:
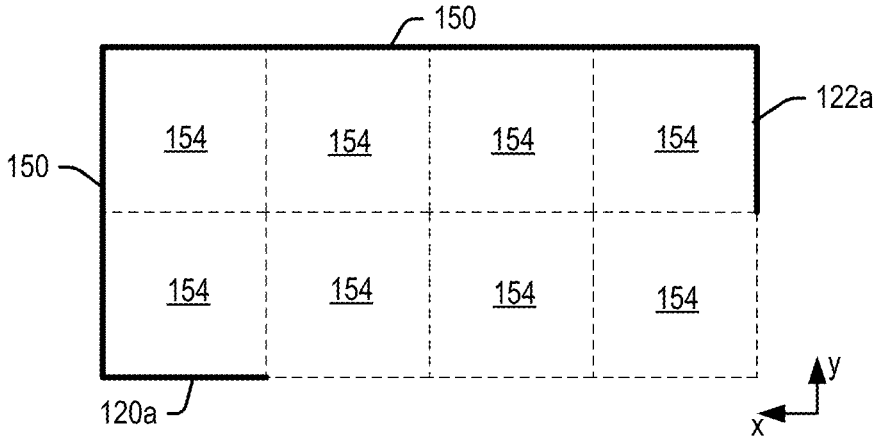

FIG. 3 is a schematic plan view of the room 102 shown in FIG. 2 illustrating unit spaces 154 defined by stationary walls 150 (not shown in FIG. 2) and movable walls panels 120, 122. In the illustrated embodiment of FIG. 2, both walls panels are in their extended positions so that room 102 is configured with its maximum footprint. In one example, this may be represented by an area having eight unit spaces 154. As shown below, the number of unit spaces will decrease when movable panels 120 and/or 122 are in their compacted positions. It is understood that the unit spaces 154 may have a variety of different dimensions in different embodiments. Moreover, it is understood that the embodiment shown in FIGS. 2 and 3 may be divided into more or less than eight unit spaces in further embodiments.

FIG. 3 also shows the configurations of wall panels 120 and 122 (in solid lines as opposed to dashed lines). In particular, in the embodiments of FIGS. 2 and 3, wall panel 120*a* extends a small distance across the front of room 102 (e.g., across one unit space 154), and wall panel 122*a* extends a small distance across the side of room 102 (e.g., across one unit space 154). With a maximum footprint and open wall panels, room 102 as configured in FIGS. 2 and 3 has the most space for the furniture or components within room 102, but is open to, and at least to an extent may form part of, communal area 104.

Figure 4:
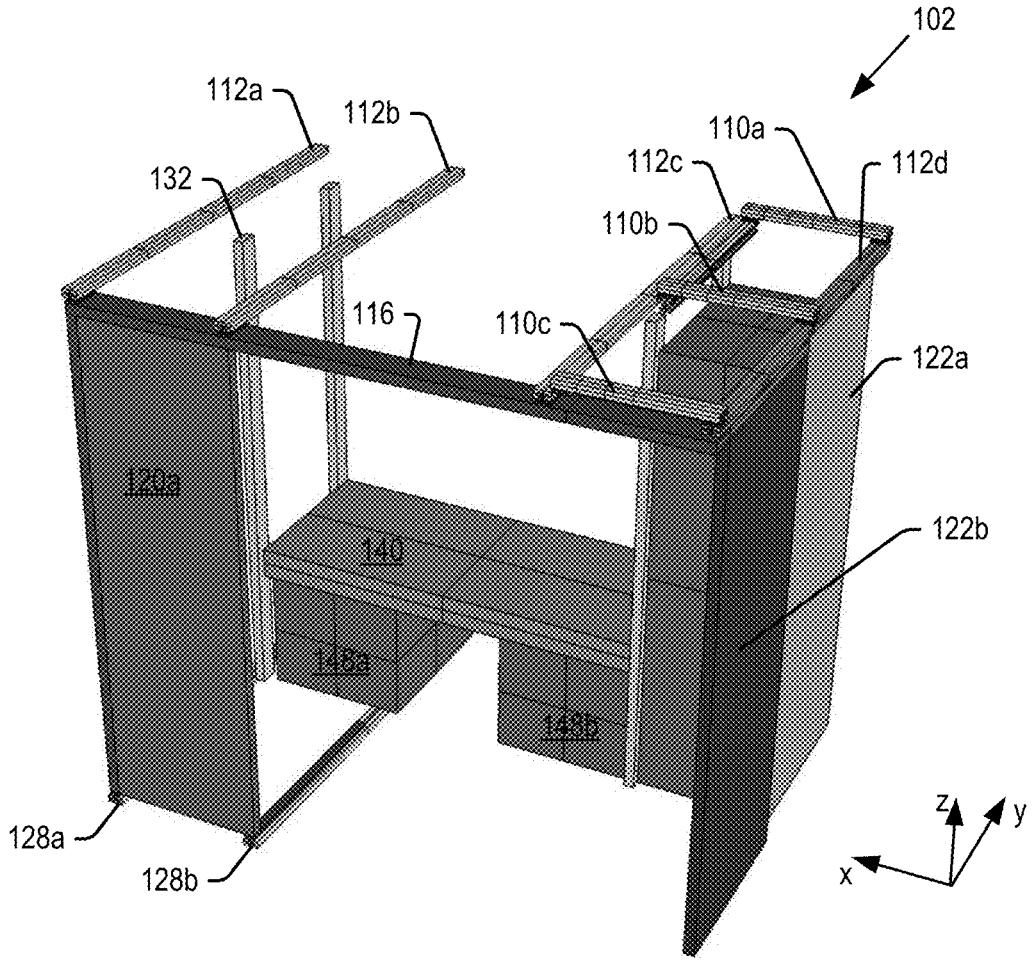
FIGS. 4 and 5 are perspective and plan views of a configuration of a room according to the present technology, expanded longitudinally and transversely, and having open front wall panels and closed side walls panels.
Figure 5:
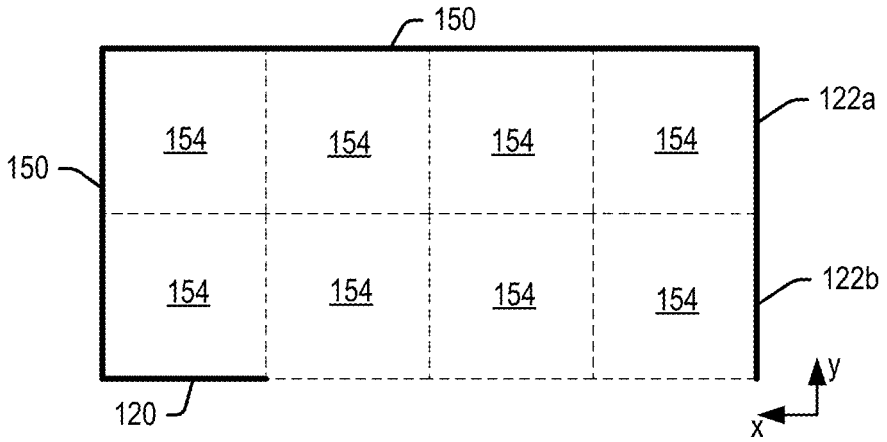

FIGS. 4 and 5 are similar to FIGS. 2 and 3, with the change that a wall panel 122*b* has been moved transversely along track 112*d* so that now wall panels 122*a* and 122*b* completely cover the side of room 102. It is understood that there may be more than two wall panels 122*a* and 122*b* in further embodiments, in which case, room 102 could be deeper than simply two unit spaces 154.

Figure 6:
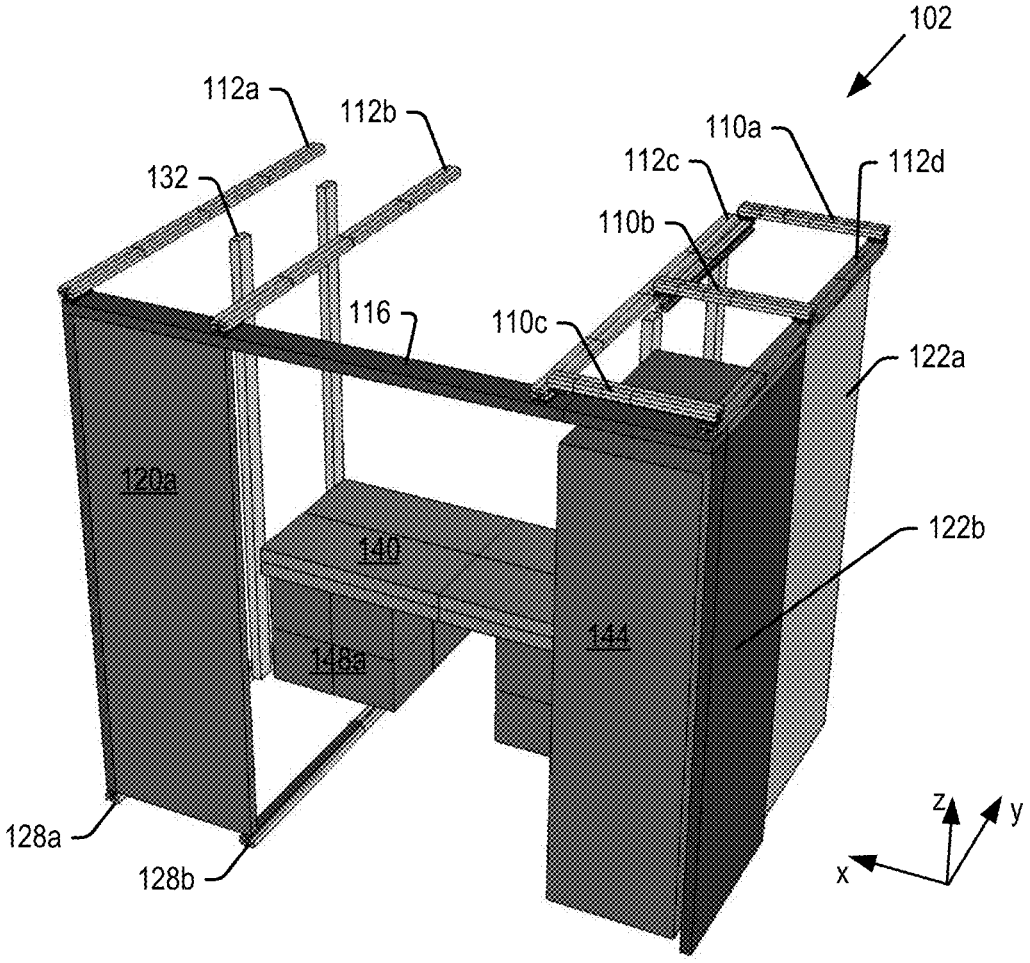
FIG. 6 is a perspective view of a configuration of a room according to the present technology with a cabinet moved transversely.
Figure 7:
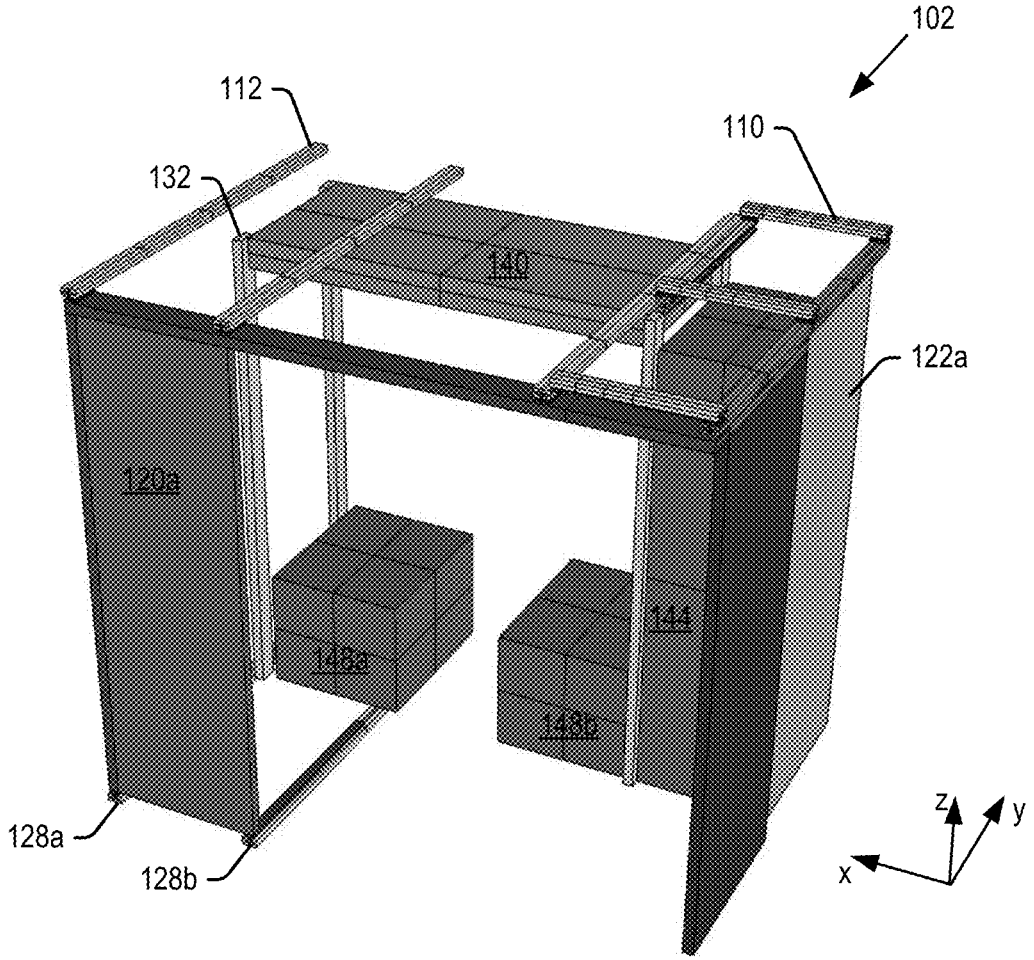
FIG. 7 is a perspective view of a configuration of a room according to the present technology with a bed moved from a deployed position to a stowed position.

In the embodiment shown in FIG. 4, the cabinet 144 is positioned between the bed 140 and the wall panel 122*a*. In FIG. 6, the cabinet 144 has been slid transversely so that is now adjacent to wall panel 122*b* at a front of room 102. Cabinet 144 may be mounted on rollers or on its own set of tracks to facilitate movement of the cabinet 144 within room 102. FIG. 2 shows bed 140 in a deployed position where it can be used for sleeping. FIG. 7 shows the bed 140 moved upward from its position shown for example in FIG. 2 to a stowed position leaving more space for other components within room 102. In particular, bed 140 may be mounted for vertical translation along vertical supports 132. Further detail of the movement of cabinet 144, bed 140 and other furniture within room 102 are explained in greater detail below with reference to FIGS. 34-38.

Figure 8:
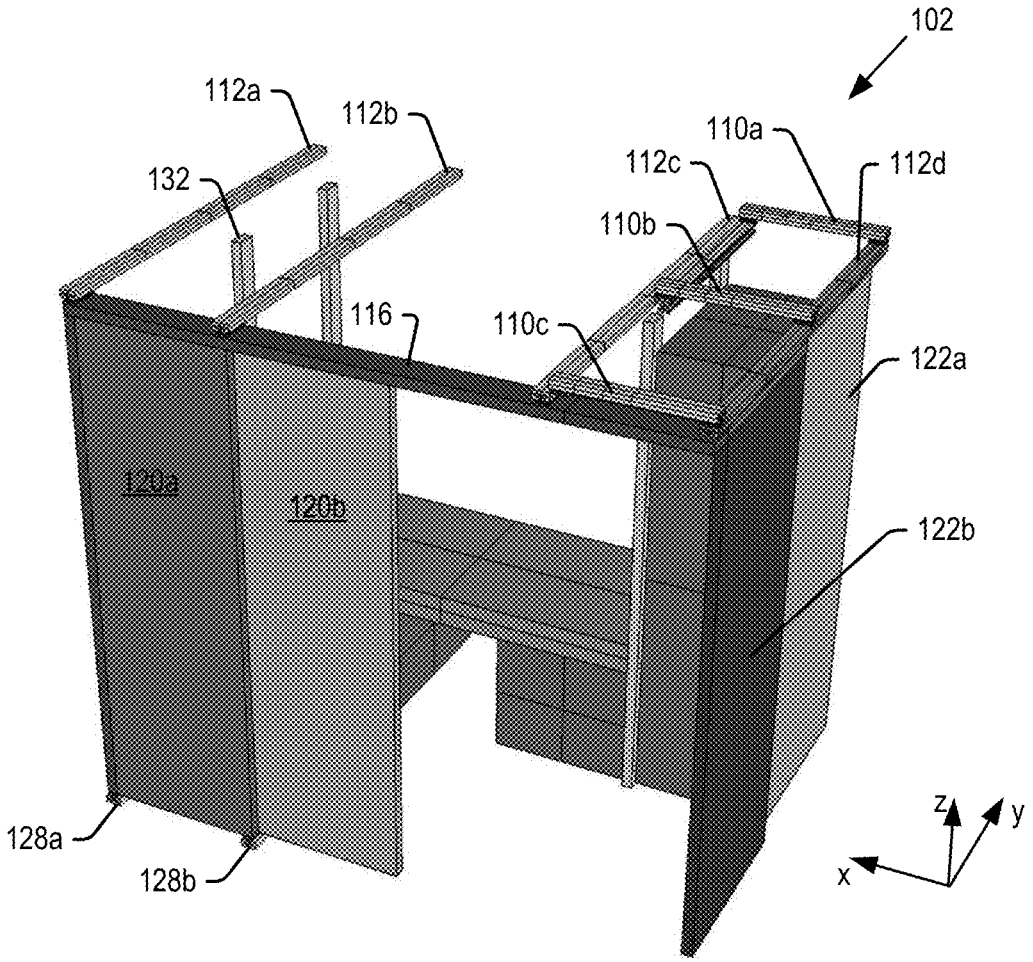
FIGS. 8 and 9 are perspective and plan views of a configuration of a room according to the present technology, expanded longitudinally and transversely, and having partially open front wall panels and closed side wall panels.
Figure 9:
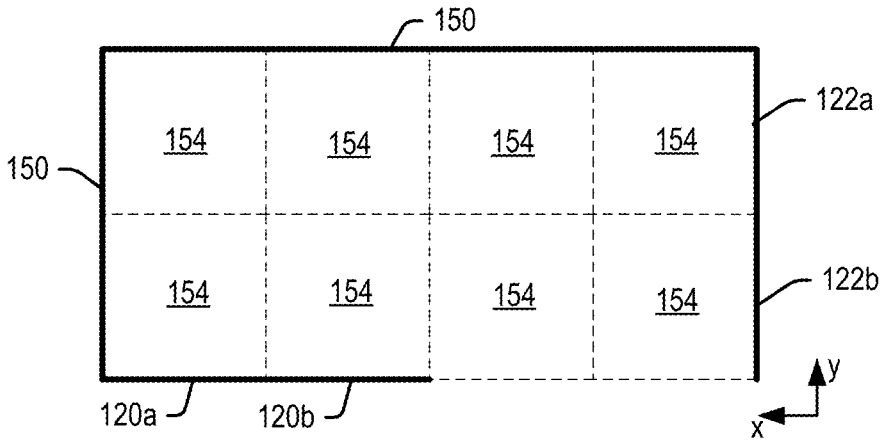
Figure 10:
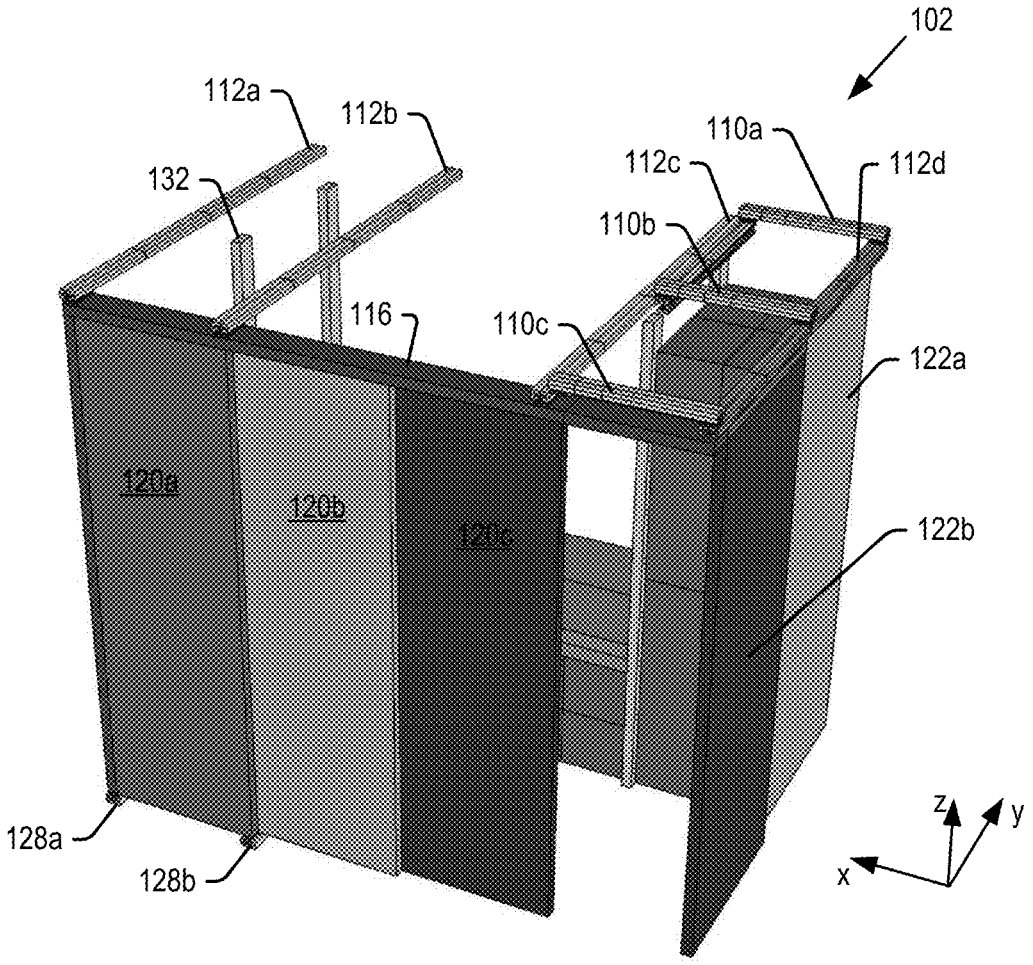
FIGS. 10 and 11 are perspective and plan views of a configuration of a room according to the present technology, expanded longitudinally and transversely, and having mostly closed front wall panels and closed side wall panels.
Figure 11:
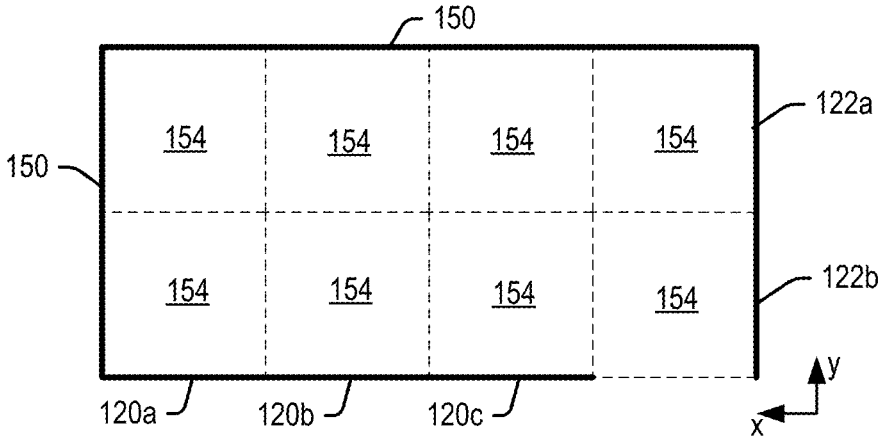
Figure 12:
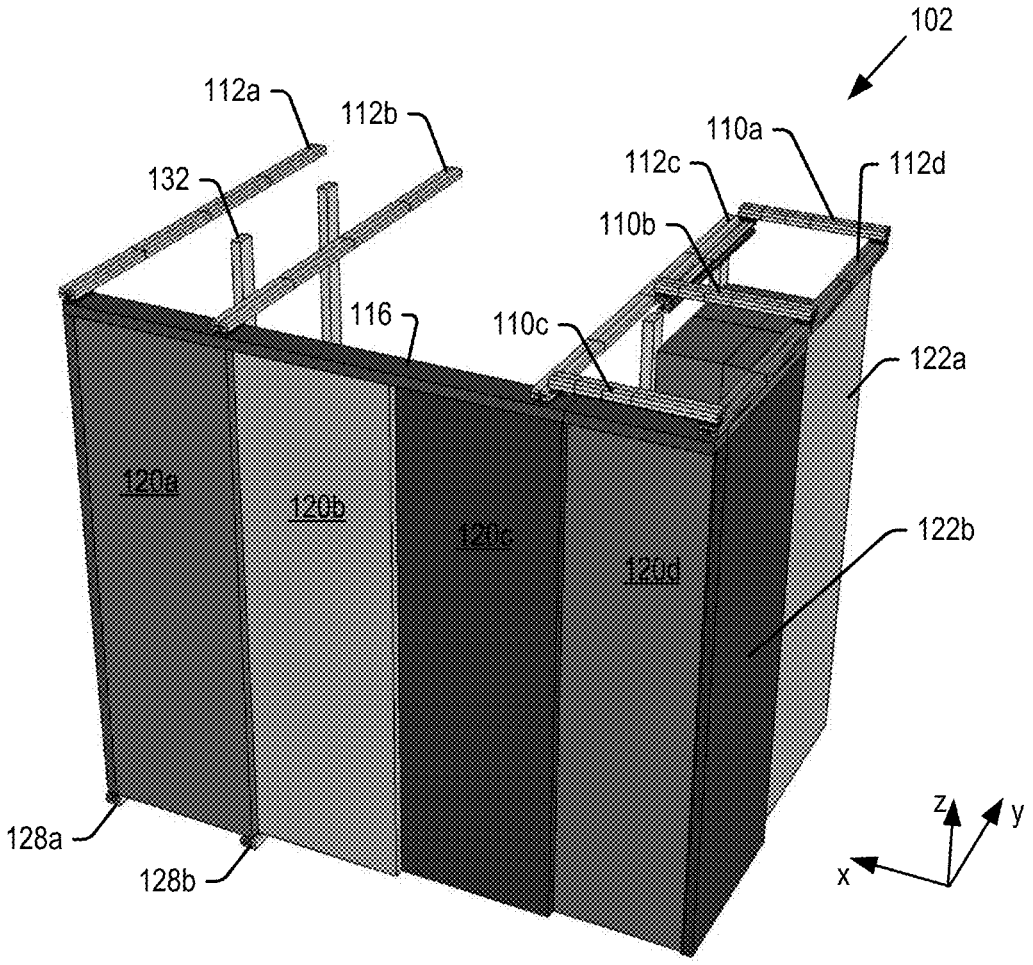
FIGS. 12 and 13 are perspective and plan views of a configuration of a room according to the present technology, expanded longitudinally and transversely, and having closed front and side wall panels.
Figure 13:
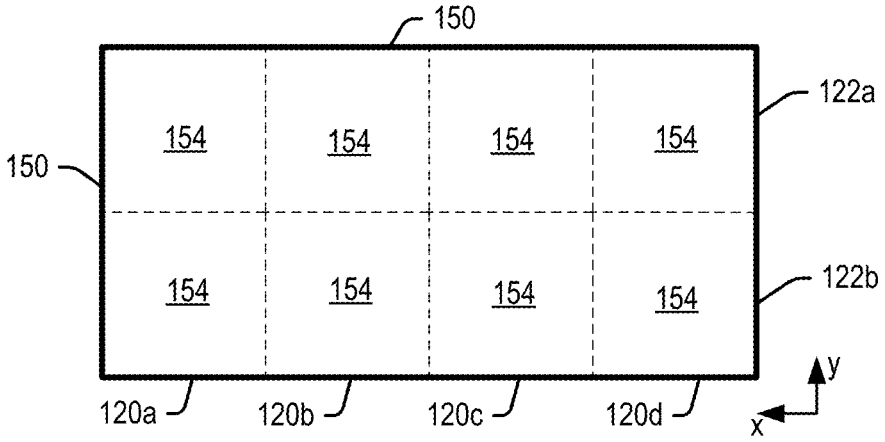

FIGS. 8 and 9 are similar to FIGS. 4 and 5, with the change that a wall panel 120*b* has been moved longitudinally along frame 116 so that now wall panels 120*a* and 120*b* sit side-by-side with respect to each other on the front side of room 102. FIGS. 10 and 11 are similar to FIGS. 8 and 9, with the change that a wall panel 120*c* has been moved longitudinally along frame 116 so that now wall panels 120*a*, 120*b* and 120*c* sit side-by-side with respect to each other on the front side of room 102. FIGS. 12 and 13 are similar to FIGS. 10 and 11, with the change that a wall panel 120*d* has been moved longitudinally along frame 116 so that now wall panels 120*a*, 120*b*, 120*c* and 120*d* sit side-by-side with respect to each other on the front side of room 102.

It is understood that there may be more or less than four wall panels 120 in further embodiments, in which case, room 102 could be longer or shorter, respectively, than four unit spaces 154. FIGS. 12 and 13 illustrate an example where panels 120 completely close off a front side of room 102, and panels 122 completely close off an adjacent side of room 102. The embodiment shown in FIGS. 12 and 13 provides both a maximum size and maximum privacy to the interior of room 102. Such a configuration may be advantageous when for example a user is sleeping or otherwise spending time within room 102.

Figure 14:
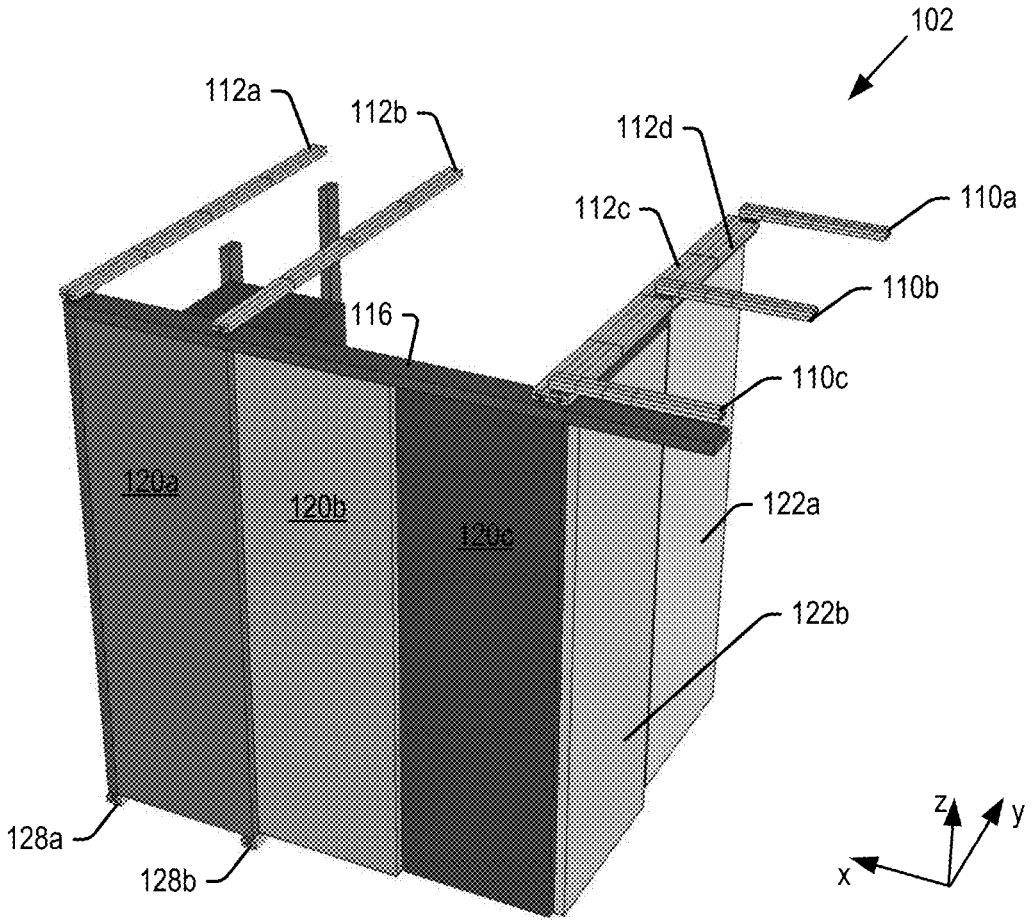
FIGS. 14 and 15 are perspective and plan views of a configuration of a room according to the present technology, compacted longitudinally and expanded transversely, and having closed front and side wall panels.
Figure 15:
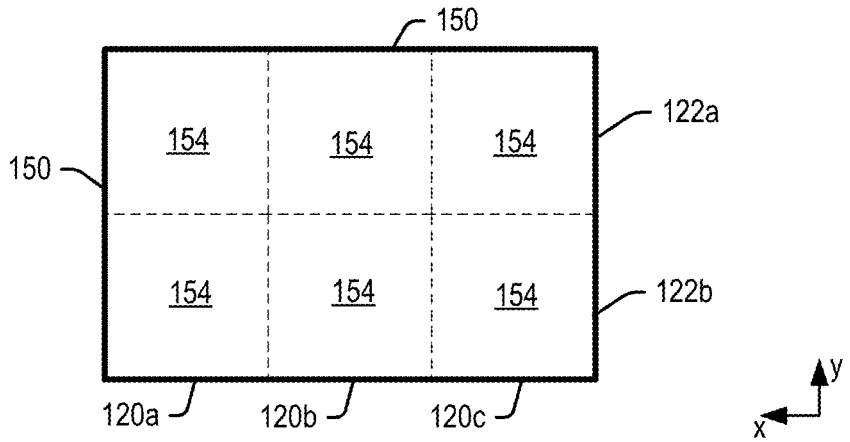

FIGS. 14 and 15 are similar to FIGS. 12 and 13, with the change that transverse track 112*d*, and wall panels 122 mounted thereon, have been moved longitudinally along tracks 110 so that now the footprint of room 102 has been made smaller by shrinking or compacting the size of the room in the longitudinal direction. As seen in FIG. 15, in one example, the room 102 may have shrunk longitudinally so as to now encompass six unit spaces 154 in a 3×2 configuration. One of the wall panels 120, for example panel 120*d*, may have retracted so as to be behind (or in front of) one of the other wall panels 120*a*, 120*b* or 120*c*. The wall panels 120 and 122 still completely close off the front and adjacent sides to provide a maximum privacy to the interior of the room 102.

Figure 16:
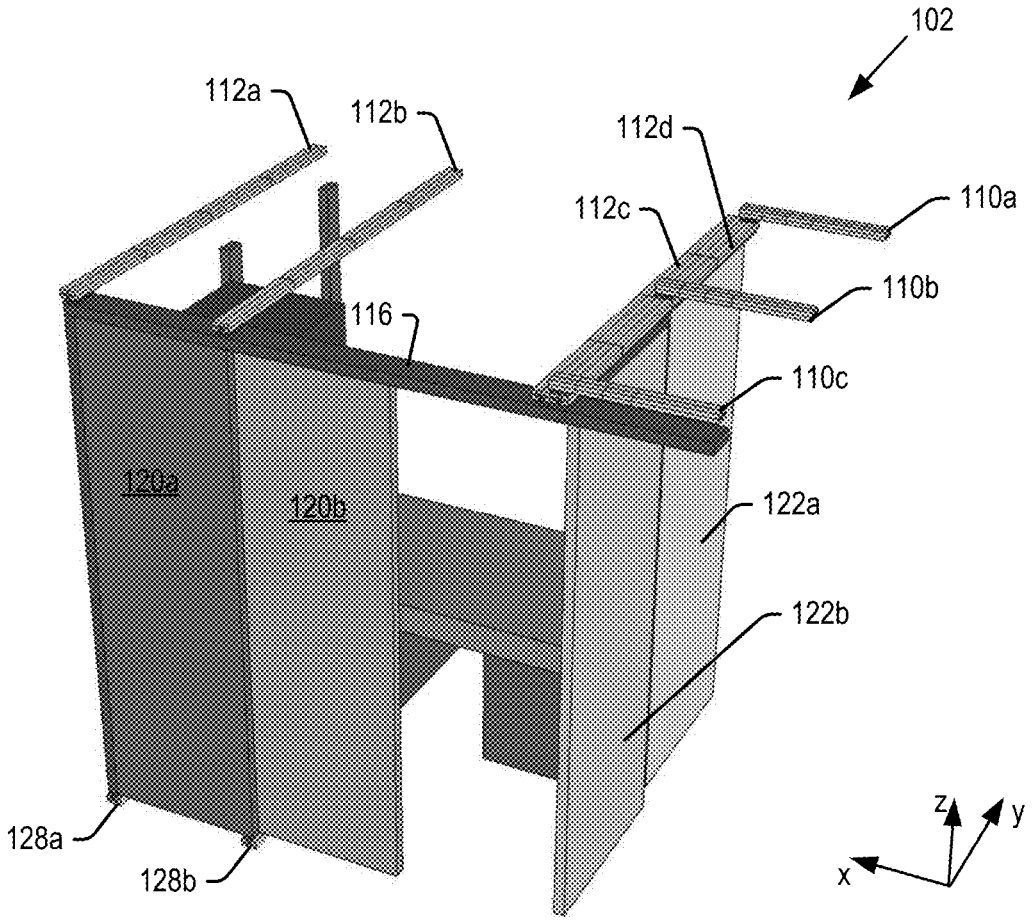
FIGS. 16 and 17 are perspective and plan views of a configuration of a room according to the present technology, compacted longitudinally and expanded transversely, and having mostly closed front wall panels and closed side wall panels.
Figure 17:
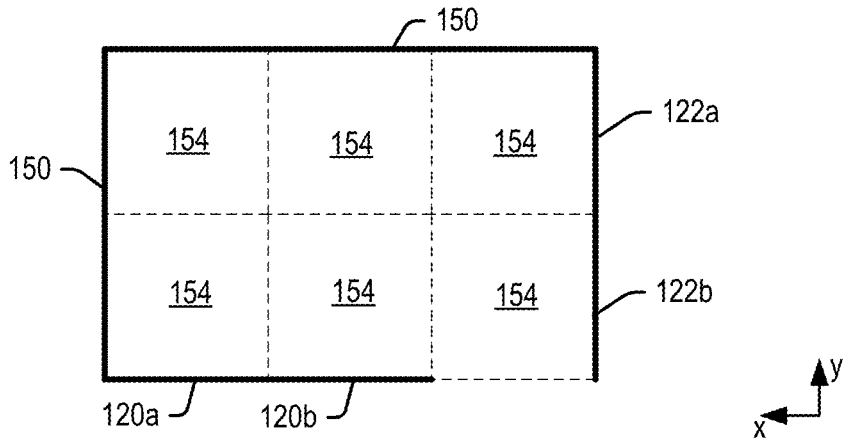
Figure 18:
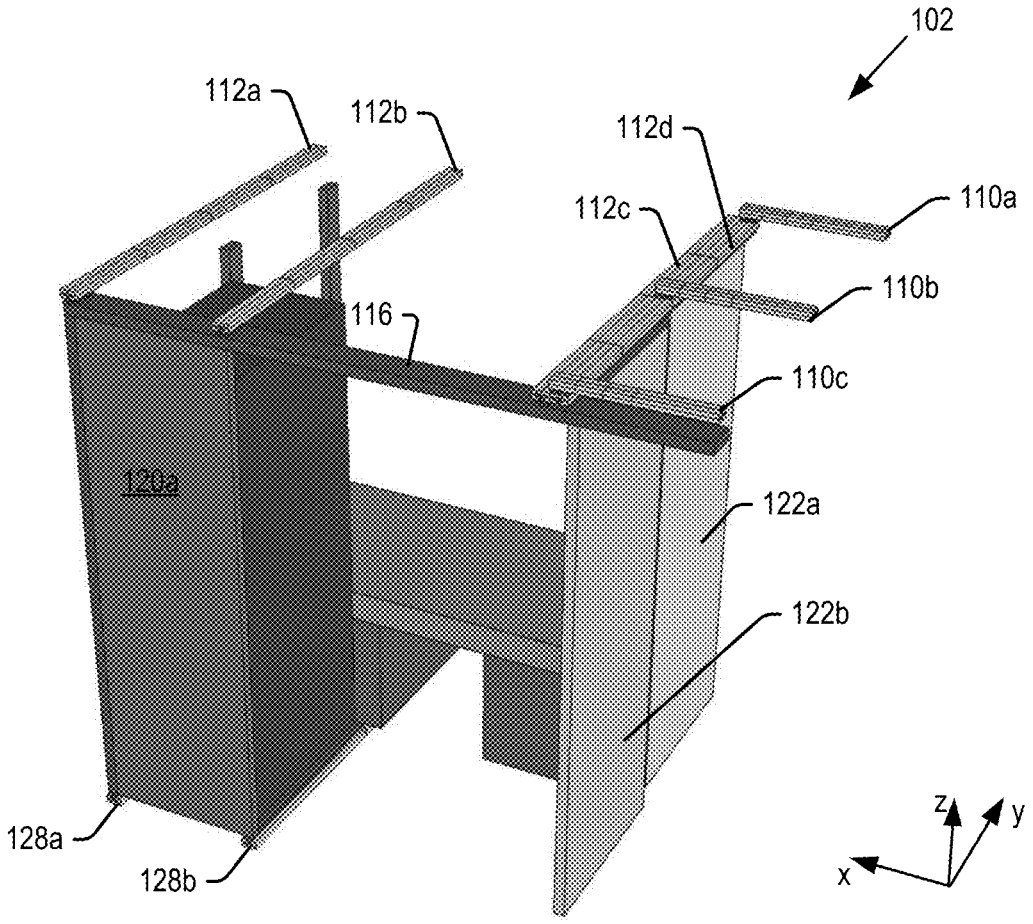
FIGS. 18 and 19 are perspective and plan views of a configuration of a room according to the present technology, including a cupboard, cabinet or other furniture, and compacted longitudinally and expanded transversely, and having open front wall panels and closed side wall panels.
Figure 19:
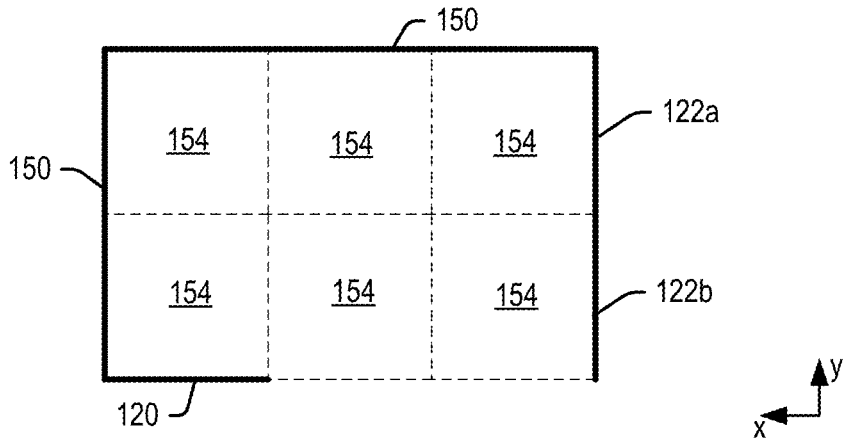
Figure 20:
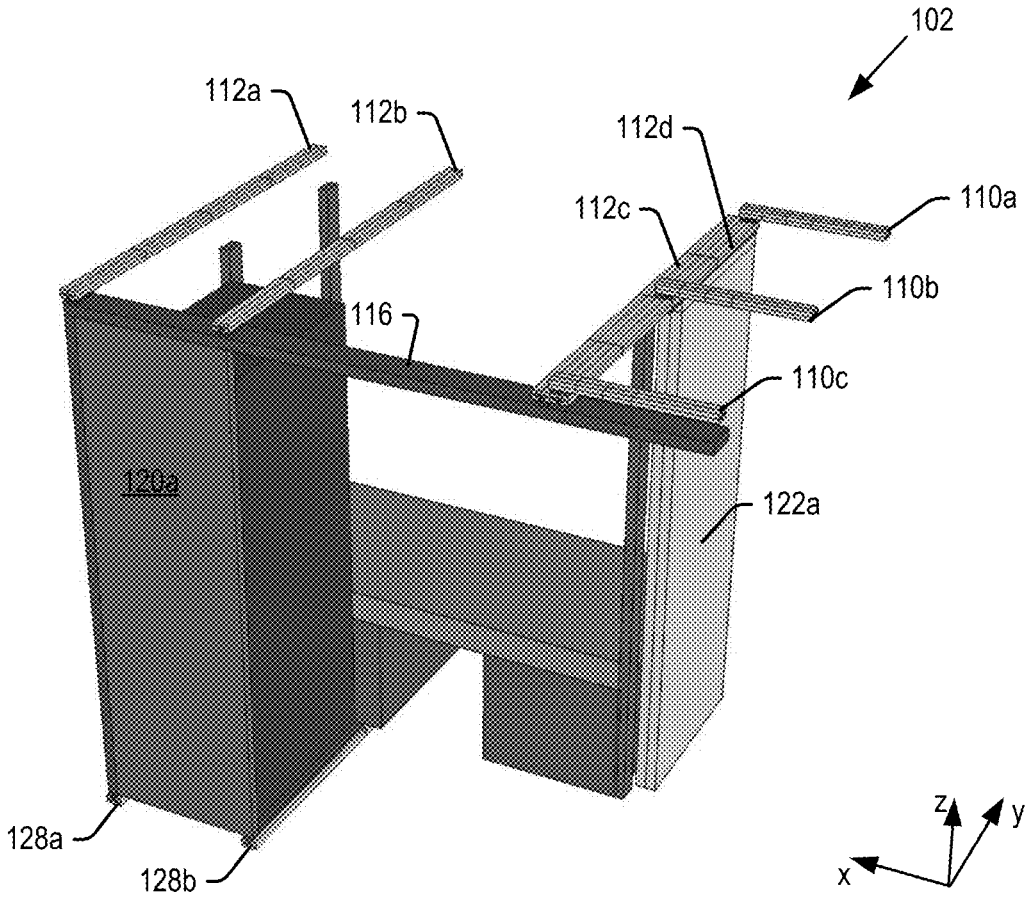
FIGS. 20 and 21 are perspective and plan views of a configuration of a room according to the present technology, compacted longitudinally and expanded transversely, and having open front and side wall panels.
Figure 21:
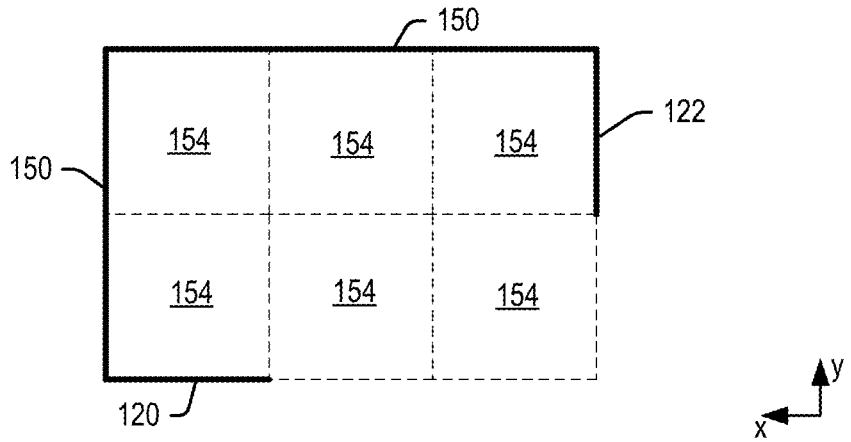

FIGS. 16 and 17 are similar to FIGS. 14 and 15, with the change that the wall panel 120*c* has been moved longitudinally along frame 116 so that now wall panels 120*a* and 120*b* sit side-by-side with respect to each other on the front side of room 102. FIGS. 18 and 19 are similar to FIGS. 16 and 17, with the change that the wall panel 120*b* has been moved longitudinally along frame 116 so that now all wall panels 120*a*, 120*b*, 120*c* and 120*d* are stacked in front of or behind each other. FIGS. 20 and 21 are similar to FIGS. 18 and 19, with the change that the wall panel 122*b* has been moved transversely along track 112*d* so that now wall panels 122*a* and 122 are stacked in front of or behind each other. FIG. 20 shows an embodiment where wall panels 120 are in an extended position and wall panels 122 are in a compacted position, while positioning the door panels in positions which provide the most open access between room 102 and communal area 104.

In the embodiments described above, tracks 110 are configured such that the track 112*d* and wall panels 122 can move longitudinally to the compacted position an amount which is approximately equal to the width of one of the front wall panels 120. It is understood that the tracks 110 may be made longer or shorter so that the track 112*d* and wall panels can compact a greater or lesser amount. This amount may be greater or lesser than a width of a front wall panel 120, or unrelated to the width of a front wall panel 120.

Figure 22:
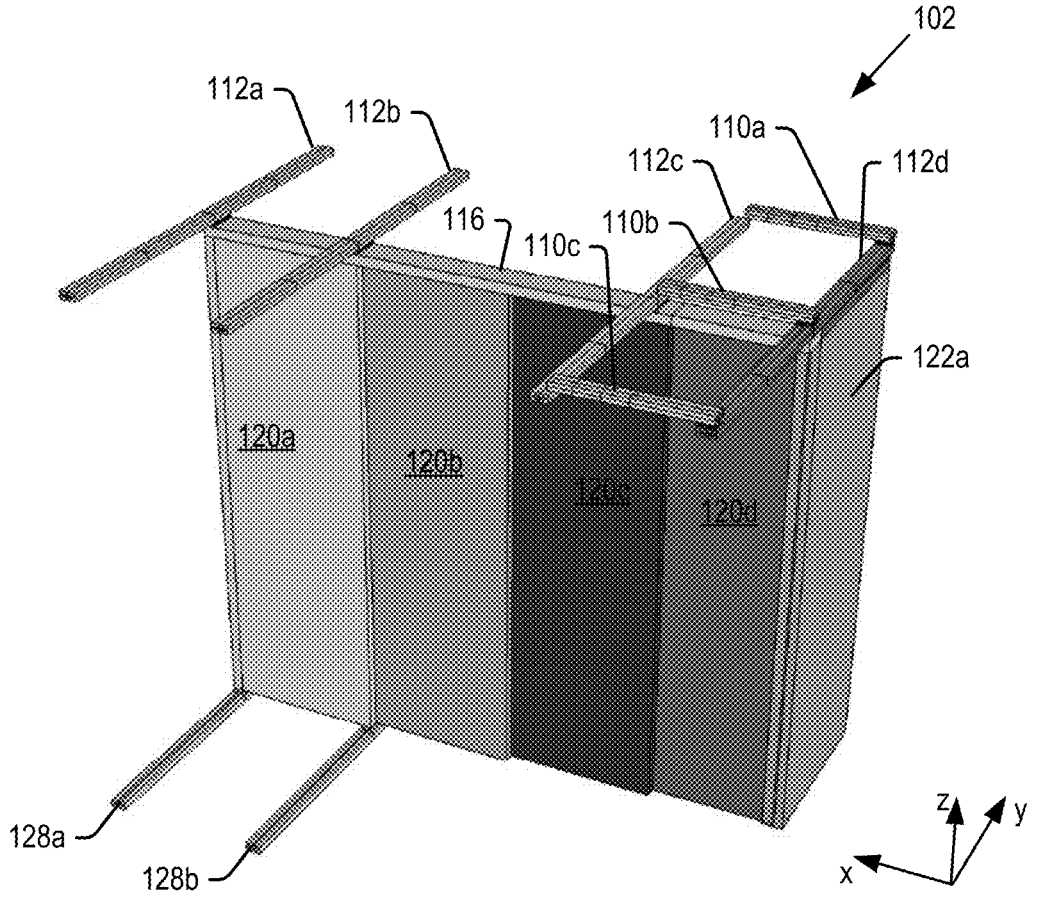
FIGS. 22 and 23 are perspective and plan views of a configuration of a room according to the present technology, expanded longitudinally and compacted transversely, and having closed front wall panels.
Figure 23:
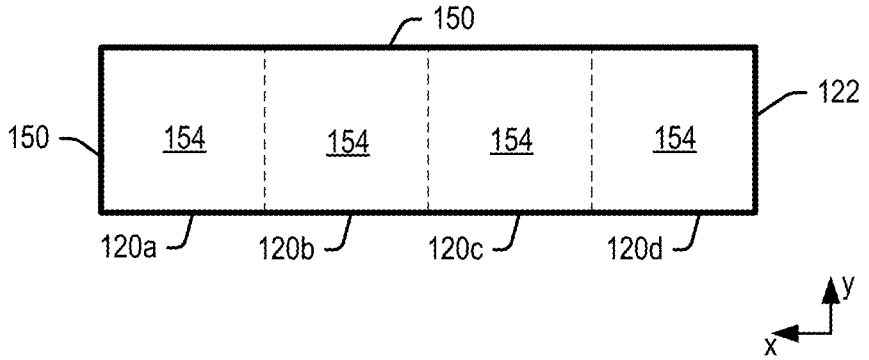

FIGS. 22 and 23 are similar to FIGS. 12 and 13 (maximum footprint and privacy), with the change that frame 116, and wall panels 120 mounted thereon, have been moved transversely along tracks 112 so that now the footprint of room 102 has been made smaller by shrinking or compacting the size of the room in the transverse direction. As seen in FIG. 23, in one example, the room 102 may have shrunk longitudinally so as to now encompass four unit spaces 154 in a 4×1 configuration. One of the wall panels 122, for example 122b, may have retracted so as to be behind (or in front of) the other wall panel. The wall panels 120 and 122 still completely close off the front and adjacent sides to provide a maximum privacy to the interior of the room 102.

Figure 24:
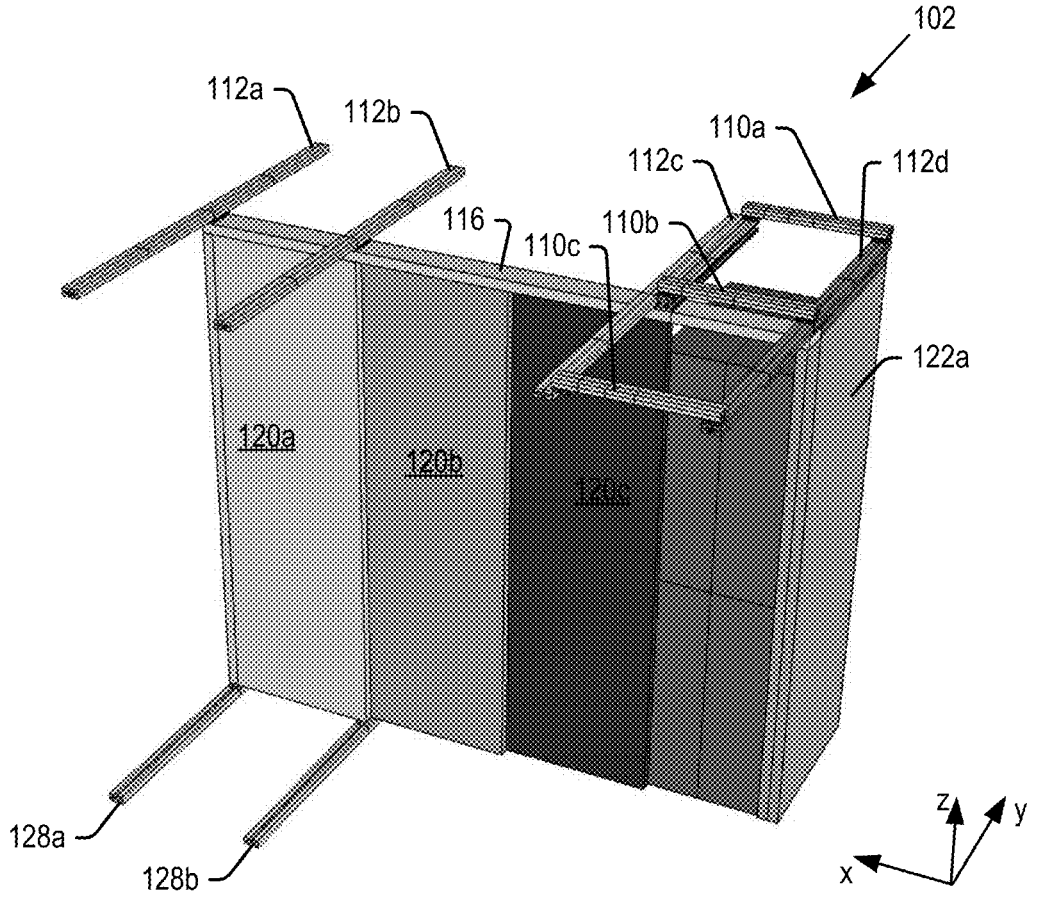
FIGS. 24 and 25 are perspective and plan views of a configuration of a room according to the present technology, expanded longitudinally and compacted transversely, and having mostly closed front wall panels.
Figure 25:
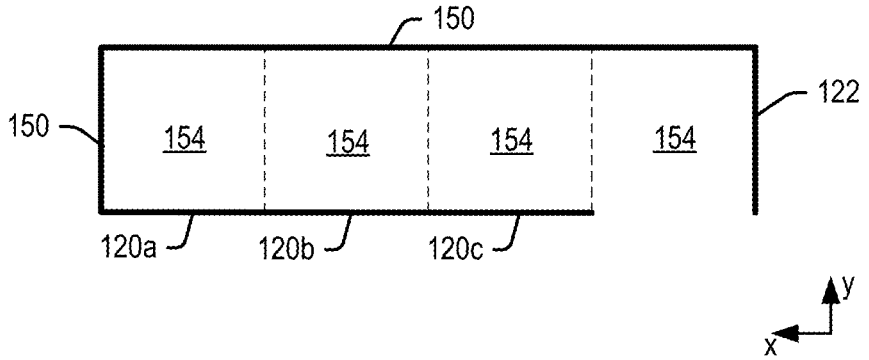
Figure 26:
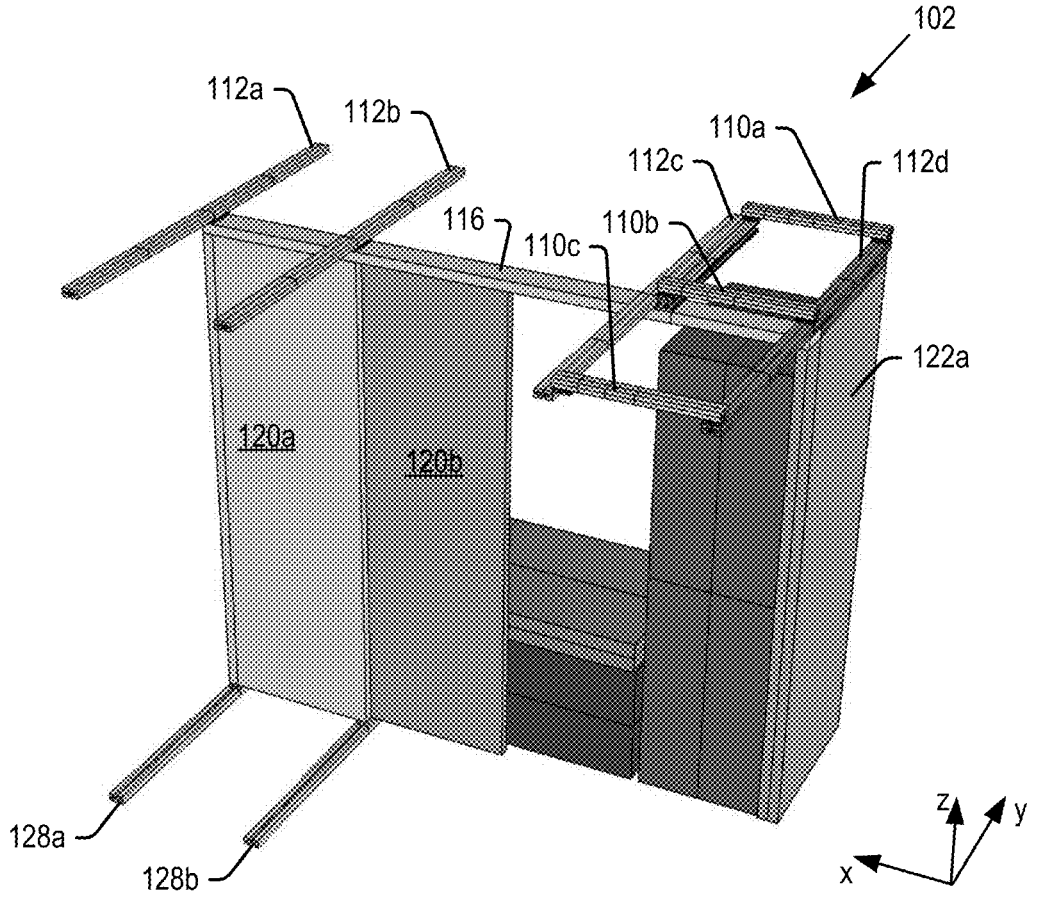
FIGS. 26 and 27 are perspective and plan views of a configuration of a room according to the present technology, expanded longitudinally and compacted transversely, and having partially open front wall panels.
Figure 27:
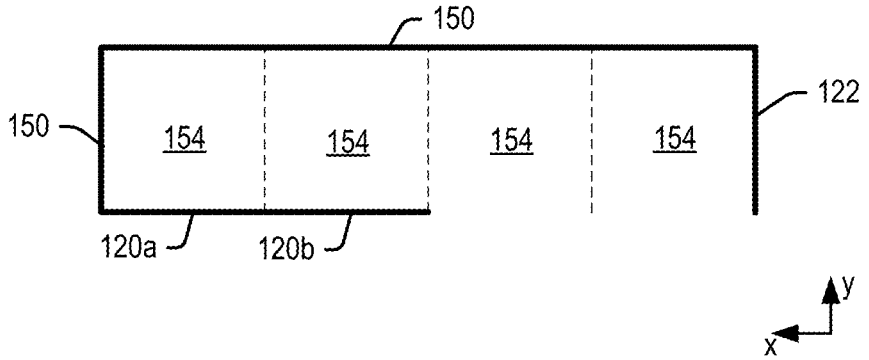
Figure 28:
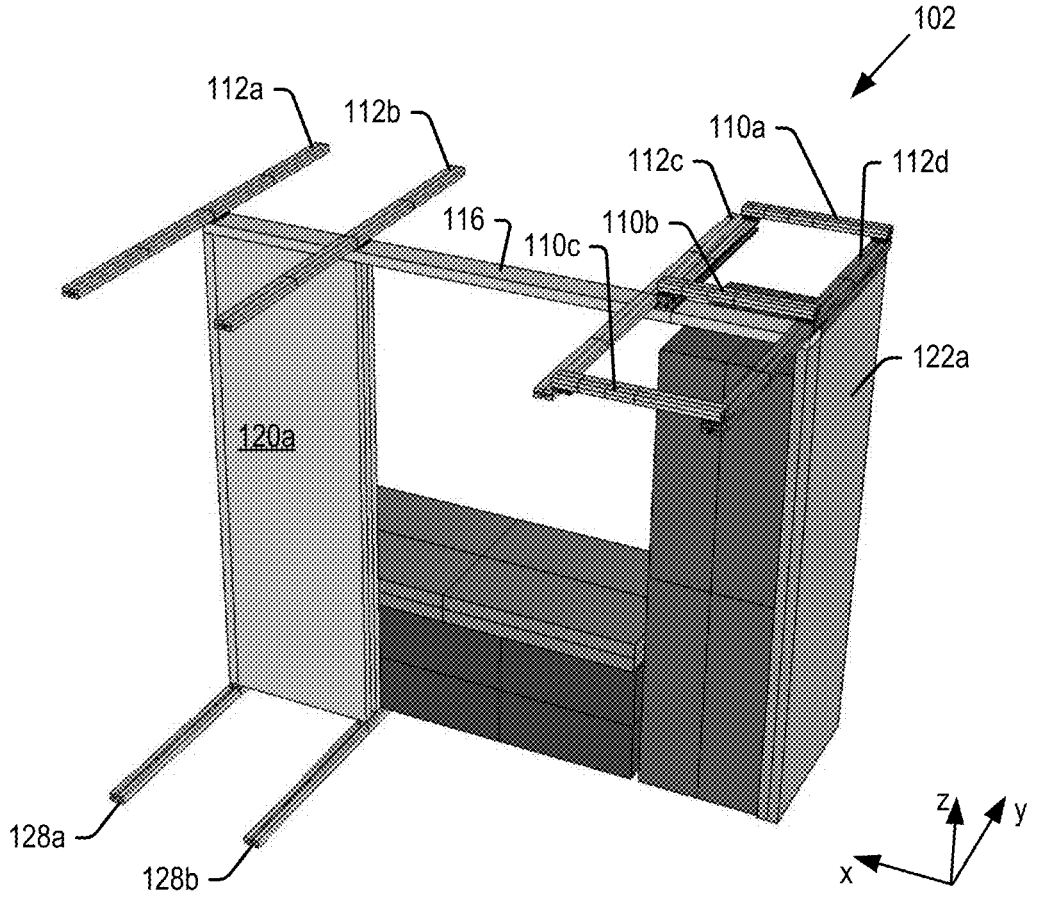
FIGS. 28 and 29 are perspective and plan views of a configuration of a room according to the present technology, expanded longitudinally and compacted transversely, and having open front wall panels.
Figure 29:
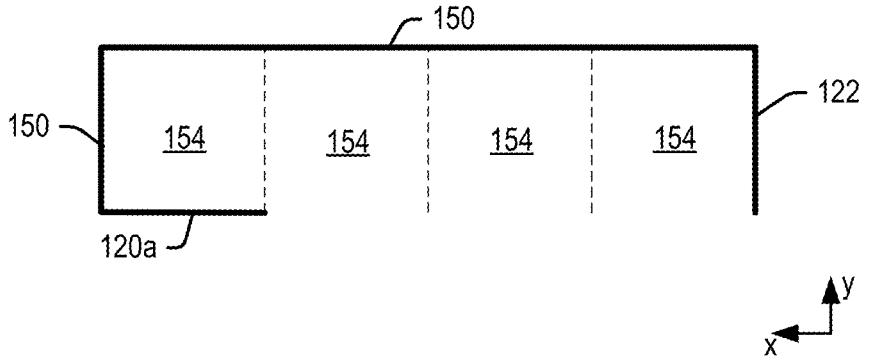

FIGS. 24 and 25 are similar to FIGS. 22 and 23, with the change that the wall panel 120*d* has been moved longitudinally along frame 116 so that now wall panels 120*a*, 120*b* and 120*c* sit side-by-side with respect to each other on the front side of room 102. FIGS. 26 and 27 are similar to FIGS. 24 and 25, with the change that the wall panel 120*c* has been moved longitudinally along frame 116 so that now wall panels 120*a* and 120*b* sit side-by-side with respect to each other on the front side of room 102. FIGS. 28 and 19 are similar to FIGS. 26 and 27, with the change that the wall panel 120*b* has been moved longitudinally along frame 116 so that now all wall panels 120*a*, 120*b*, 120*c* and 120*d* are stacked in front of or behind each other. FIG. 28 shows an embodiment where wall panels 120 are in a compacted position and wall panels 122 are in an extended position, while positioning the door panels in positions which provide the most open access between room 102 and communal area 104.

In the embodiments described above, the room is shown such that the frame 116 and wall panels 120 can move transversely to the compacted position an amount which is approximately equal to the width of one of the side wall panels 122. It is understood that the tracks and room 102 may be configured so that the frame 116 and wall panels can compact a greater or lesser amount. This amount may be greater or lesser than a width of a side wall panel 122, or unrelated to the width of a front wall panel 122.

Figure 30:
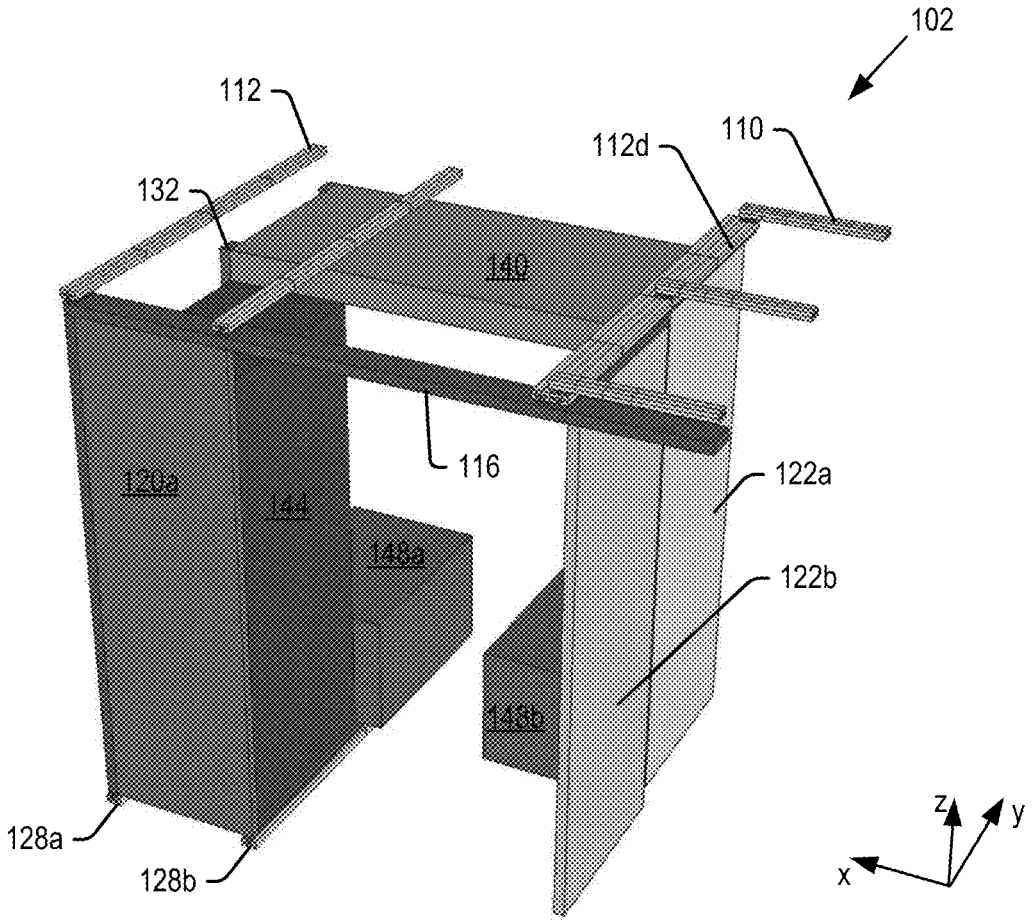
FIGS. 30 and 31 are perspective and plan views of a configuration of a room according to the present technology, expanded longitudinally and compacted transversely, and having open front wall panels and closed side wall panels.
Figure 31:
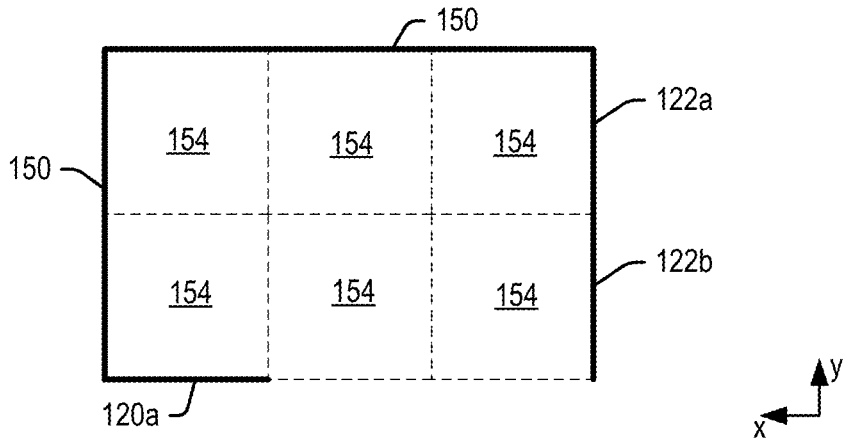
Figure 32:
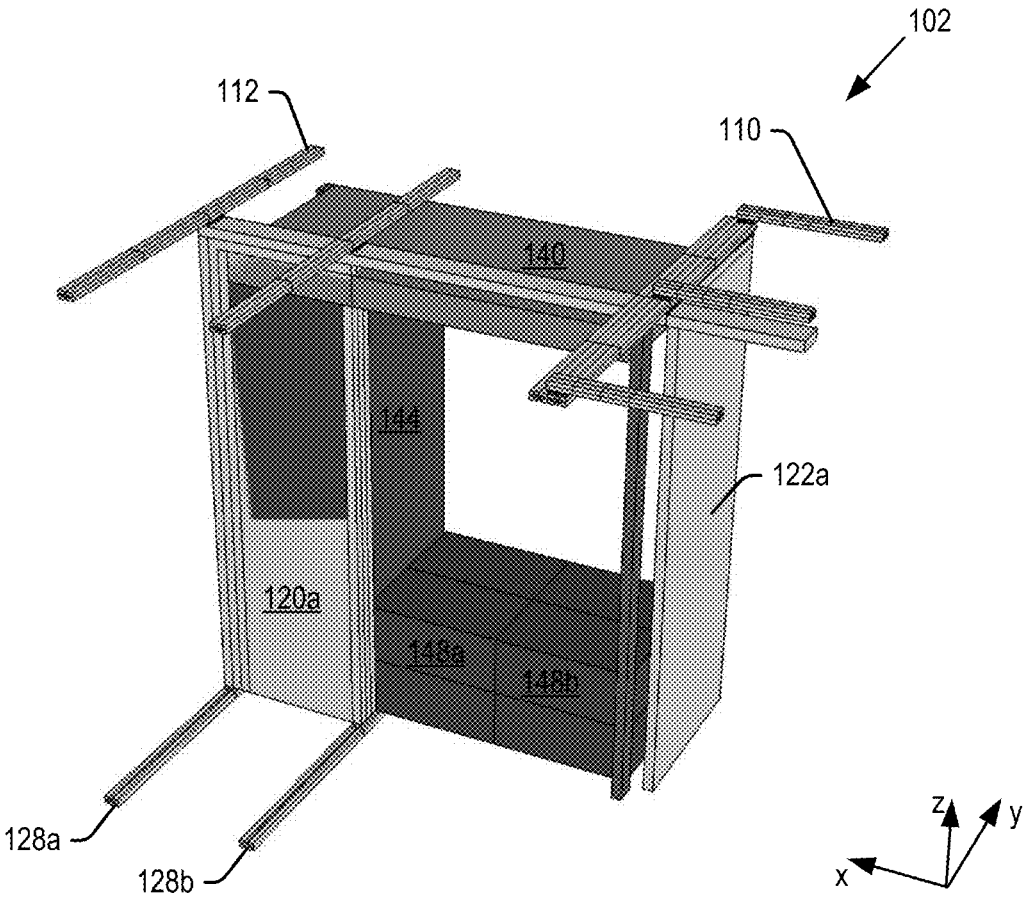
FIGS. 32 and 33 are perspective and plan views of a configuration of a room according to the present technology, compacted longitudinally and transversely, and having open front wall panels.
Figure 33:
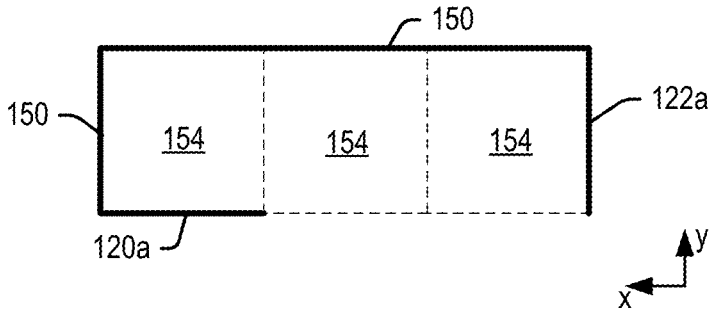

FIGS. 30 and 31 illustrate an embodiment where the transverse track 112*d* and wall panels 122 are in a compacted position, and the frame 116 and wall panels 120 are in an extended position. In this configuration, the bed 140 is shown raised to its stowed position. In embodiments, the cabinet 144 has a height such that it fits beneath the bed 140 when the bed 140 is in its stowed position. FIGS. 32 and 33 are similar to FIGS. 30 and 31, with the change that frame 116 and wall panels 120 have been moved transversely along tracks 112 so that now the footprint of room 102 has been made smaller by compacting the size of the room in the transverse direction. With the frame 116 and wall panels 120 in their compacted positions, and with the track 112*d* and wall panels 122 in their compacted positions, FIG. 33 illustrate the smallest footprint achievable in the embodiments shown. As seen in FIG. 33, in one example, the room 102 may have three unit spaces 154 in a 3×1 configuration. Such a configuration may be the same size as, or slightly greater than, a footprint of bed 140.

In embodiments described above, wall panels 120 and 122 are solid members, formed for example of wood, engineered wood, plastic, metal, glass or combinations thereof. Instead of wall panels 120 described above, the front section of room 102 may be covered with articles that can be mounted to frame 116 so as to move transversely with frame 116, and which can also move longitudinally along frame 116 to open, partially close or fully close off the front section of room 102. Such articles may include curtains mounted to frame 116, or an accordion-type door mounted to frame 116. The same can be used in placed of wall panel 122 to move longitudinally with track 112*d*, and which can also move transversely across track 112*d* to open, partially close or fully close off the side section of room 102.

Figure 34:
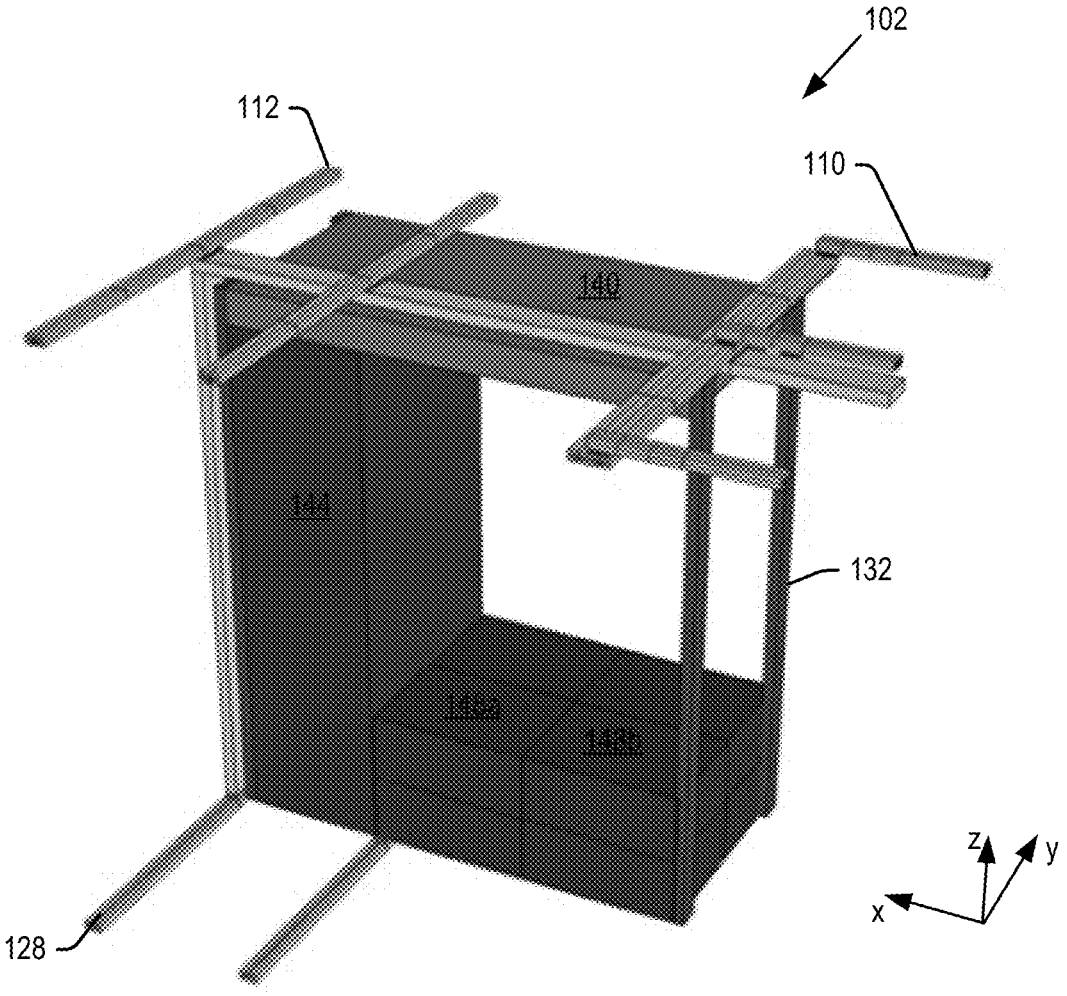
FIGS. 34-38 are perspective views of different configurations of a room according to the present technology showing different arrangements of furniture within the room.

FIG. 32 shows wall panels 120 with an upper section removed for ease of understanding of the configuration of the interior of room 102. FIG. 34 shows the same configuration of room 102 as in FIG. 32, but with the wall panels removed altogether for ease of understanding of the configuration of the interior of room 102. As seen in FIG. 32, in its most compact footprint, room 102 can still house bed 140, cabinet 144, storage containers 148 and other furniture. Relative to the embodiment shown in FIG. 30, the storage containers 148 have been moved together to make room for the cabinet 144 which may be slid in the transverse direction, beneath bed 140, to fit next to the storage containers 148 and/or seating. The configuration shown in FIGS. 32 and 34 may be provided to maximize the size of communal area 104 or when room 102 is otherwise not in use. As in the embodiments above, panels 120 may be slid longitudinally to partially (two-thirds) close off the interior of room 102, or completely close off the interior of room 102.

Figure 35:
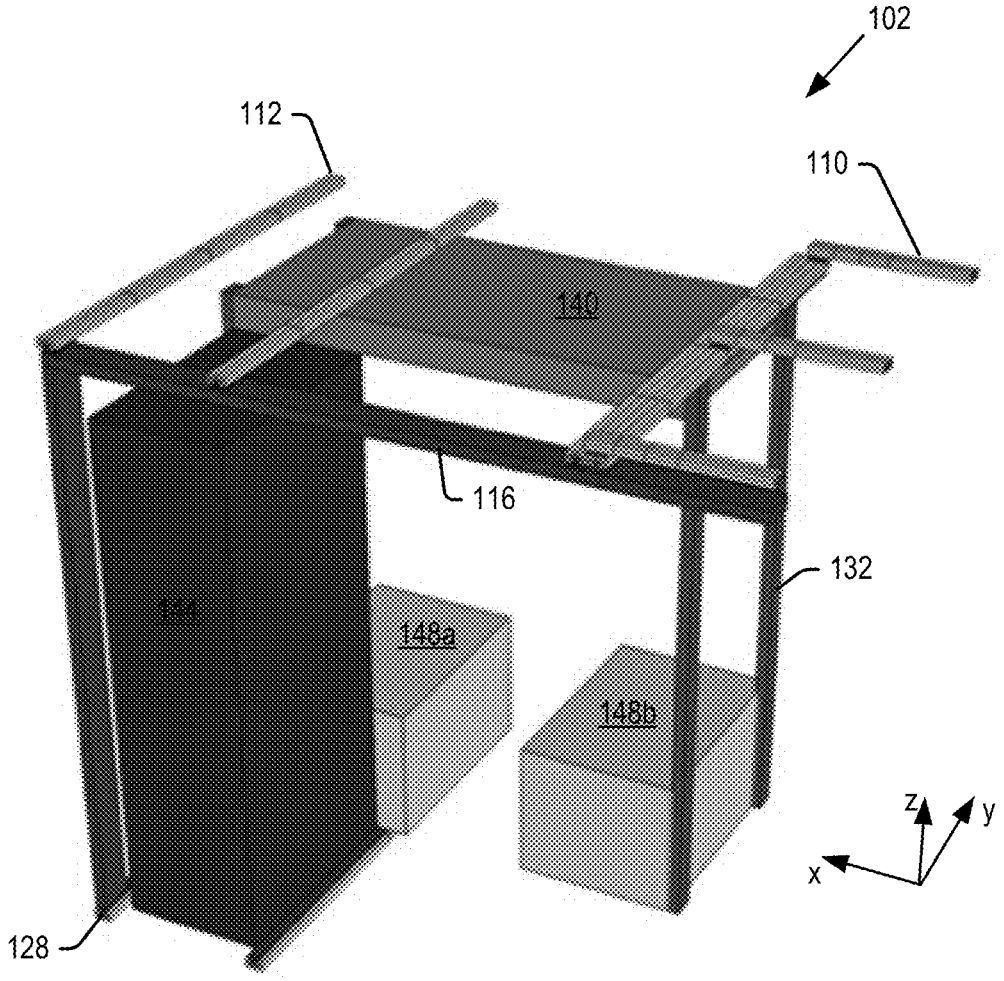
Figure 36:
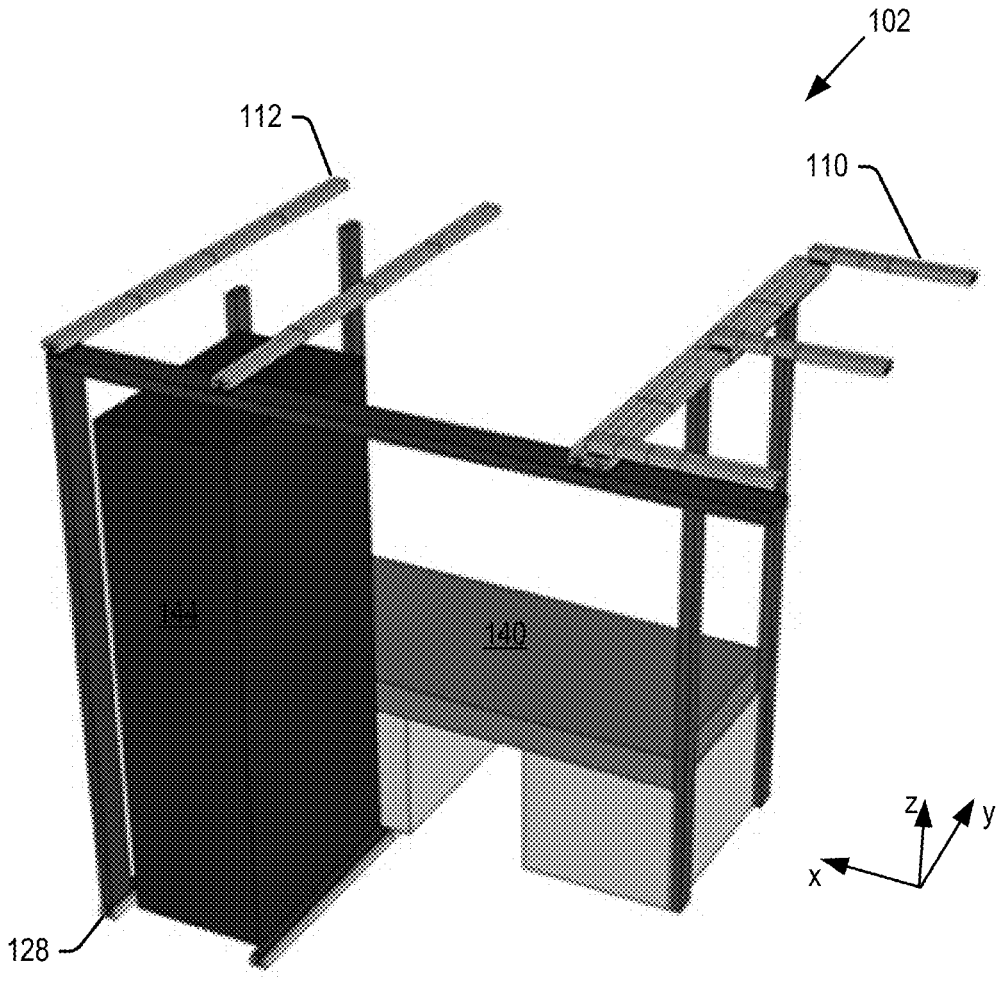

FIG. 35 illustrates an embodiment where frame 116 and wall panels 120 (not shown in FIG. 35) have been moved to the extended position in cabinet 144 has been slid transversely from beneath bed 140. Once the cabinet 144 is removed, bed 140 may be moved from its stowed position to its deployed position as shown in FIG. 36. As noted above, bed 140 may be mounted on vertical supports 132 so as to be movable between its stowed and deployed positions. The bed 140 may be moved manually along supports 132 and locked in its deployed or stowed positions. Chains and counterweights may be provided on one or more the vertical supports, affixed to and pulling up on the bed, to make it easy to move the bed 140 up or down. Alternatively, the bed may be suspended from the ceiling on supports or chains that allow vertical movement of the bed 140. In further embodiments, a motor and control switch may be provided for automated movement of the bed between the deployed and stowed positions.

Figure 37:
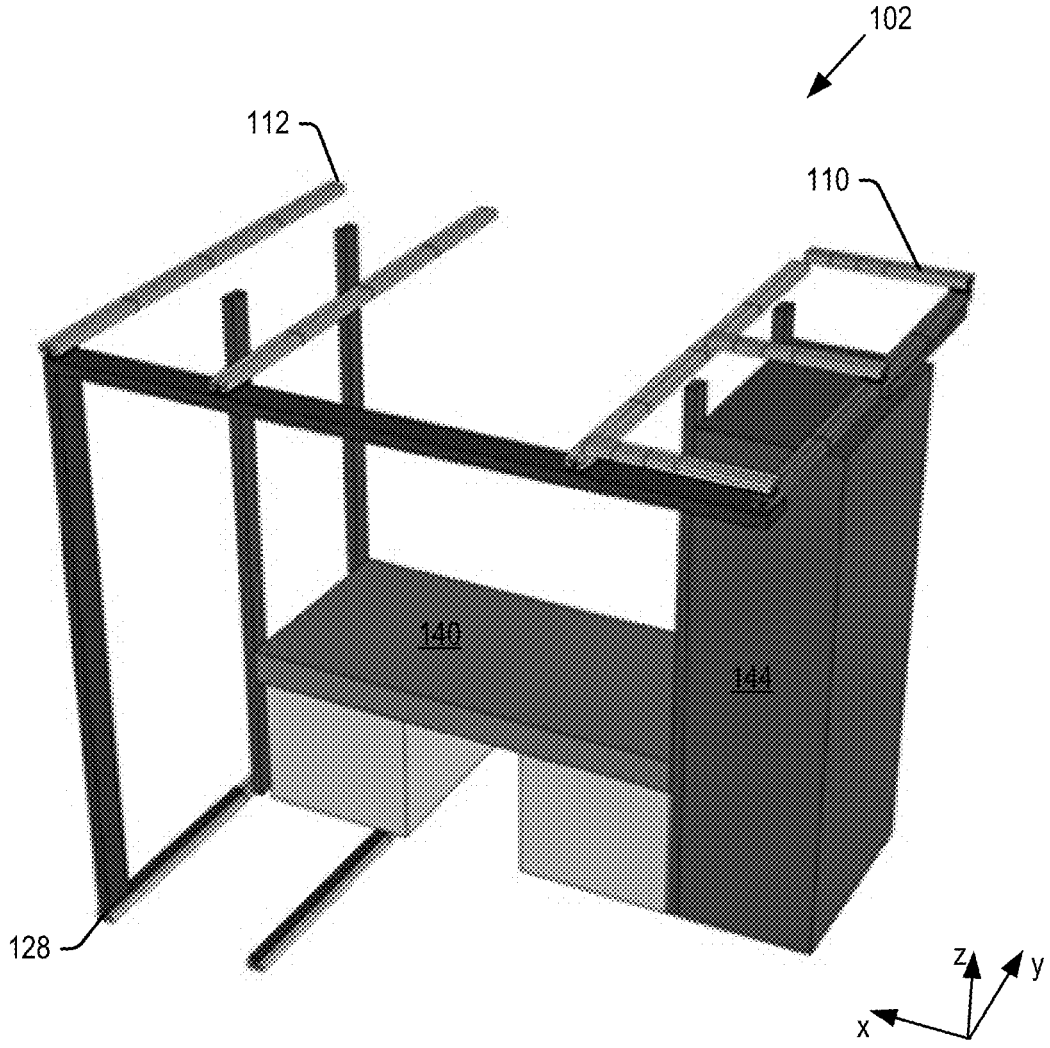
Figure 38:
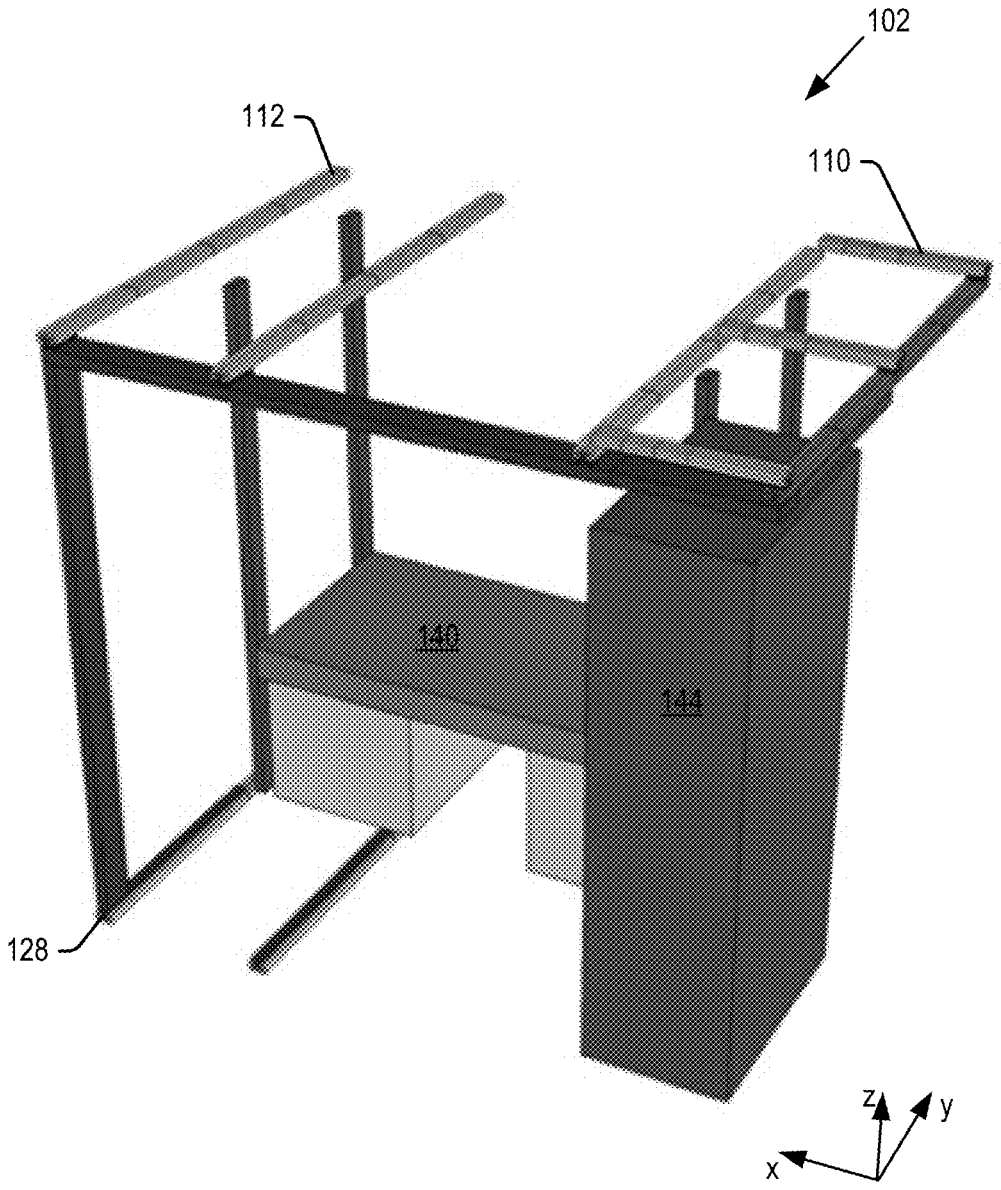

The type, number and positions of the furniture within room 102 may vary depending on the room configuration and the type of the room 102. Where for example the room 102 is expanded in the transverse direction and compacted in the longitudinal direction, the cabinet 144 may be placed next to the bed 140 as shown in FIG. 36. Where for example the room 102 is compacted in the transverse direction and expanded in the longitudinal direction, the cabinet 144 may be placed at the head or foot of the bed 140 as shown in FIG. 37. Where for example the room 102 is expanded in the transverse direction and expanded in the longitudinal direction, the cabinet 144 may be placed diagonally from the bed 140 as shown in FIG. 38. As noted, one or more of the bed 140, cabinet 144 and storage containers 148 may be omitted in further embodiments, and/or used with other furniture or components within room 102, including for example chairs.

In embodiments described above, the room 102 includes sliding walls on two sides of a room that move in the transverse and longitudinal directions to make the room reconfigurable. Such an embodiment may include two stationary walls 150 as described above. In further embodiments, one or both stationary walls 150 may be replaced by wall panels 120, 122 so that three or four walls of room 102 are configured to move transversely and/or longitudinally. Thus, the room 102 may include opposed sets of walls where each of the opposed walls is configured to move closer to or farther from each other, as well as including wall panels that are configured to slide relative to each other. In such an embodiment, the room 102 (including four moving walls) may form a defined spaced within another larger room or area.

Moreover, in embodiments, instead of the room 102 including sliding walls on two sides of a room, room 102 may include sliding walls on one side of the room. In such embodiments, the room would be reconfigurable in the transverse direction or the longitudinal direction, but not both.

In summary, in one example, the present technology relates to a living space, comprising: a communal area; a room adjoining the communal area, the room comprising: a first wall along a first side of the room, the first wall configured to expand and retract along its length, and to move in a first direction orthogonally to its length; and a second wall along a second side of the room, the second side being adjacent the first side, the second wall configured to expand and retract along its length, and to move in a second direction orthogonally to its length.

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

I claim:

1. A living space, comprising:

an area;

a room adjoining the area, the room comprising:

a first wall along a first side of the room, the first wall configured to expand and retract along its length, and to move in a first direction orthogonally to its length; and a second wall along a second side of the room, the second side being adjacent the first side, the second wall configured to expand and retract along its length, and to move in a second direction orthogonally to its length.

2. The living space of claim 1, wherein the first wall is comprised of two or more wall panel sections mounted in different planes so as to retract in an overlapped arrangement in front of and behind each other, and to expand so that the wall panel sections do not overlap.

3. The living space of claim 1, wherein the first wall is mounted on a track so as to move along a length of the track, and wherein the track is mounted for translation orthogonally to the length of the track.

4. The living space of claim 1, wherein the first and second walls close off the room from the area when the first and second walls are expanded along their length.

5. The living space of claim 1, further comprising a first configuration where the first and second walls are positioned along the first and second directions to maximize a footprint of the room.

6. The living space of claim 5, further comprising a second configuration where the first and second walls are positioned along the first and second directions to maximize a dimension of the room in the first direction and to minimize a dimension of the room in the second direction.

7. The living space of claim 1, further comprising a first configuration where the first and second walls are positioned along the first and second directions to minimize a footprint of the room.

8. The living space of claim 7, further comprising a bed, wherein the minimized footprint of the room is approximately equal to a length and width of the bed.

9. The living space of claim 8, wherein the bed is configured to move vertically between a deployed position and a stowed position.

10. The living space of claim 9, further comprising a cabinet, wherein the cabinet is configured to fit underneath the bed when the bed is in a stowed position.

11. The living space of claim 7, further comprising a bed having first and second ends defining a length of the bed, and a cupboard having a front surface and a back surface defining a width of the cupboard, one of the front and back surfaces of the cupboard positioned adjacent one of the first and second ends of the bed, wherein the minimized footprint of the room is approximately equal to a longitudinal length comprising the length of the bed and the width of the cupboard, and a transverse width comprising a width of the bed.

12. The living space of claim 1, wherein the area is a communal area and the room is a bedroom.

13. A living space, comprising:

an area;

a room adjoining the area, the room comprising:

a first wall along a first side of the room;

a first track for supporting the first wall, the first wall configured to slide in a first direction along the length of the first track;

a second track, the first track mounted to the second track and the first track configured to slide in a second direction, different than the first direction, along the length of the second track;

a second wall along a second side of the room adjacent the first side of the room;

a third track for supporting the second wall, the second wall configured to slide in a third direction along the length of the third track; and a fourth track, the third track mounted to the fourth track and the third track configured to slide in a fourth direction, different than the third direction, along the length of the fourth track.

14. A living space of claim 13, wherein the first and second directions are orthogonal to each other.

15. A living space of claim 13, wherein the third and fourth directions are orthogonal to each other.

16. A living space of claim 13, wherein the first and fourth directions are parallel to each other, and the second and third directions are parallel to each other.

17. The living space of claim 13, wherein the first wall is comprised of two or more wall panel sections mounted in different planes in the first track so as to retract in an overlapped arrangement in front of and behind each other, and to expand so that the wall panel sections do not overlap.

18. The living space of claim 13, wherein the first and second walls close off the room from the area when the first and second walls are expanded along their length.

19. The living space of claim 13, further comprising a first configuration where the first and second walls are positioned along the first, second, third and fourth directions to minimize a footprint of the room.

20. The living space of claim 19, further comprising a bed, wherein the minimized footprint of the room is approximately equal to a length and width of the bed.

21. The living space of claim 20, wherein the bed is configured to move vertically between a deployed position and a stowed position.

22. The living space of claim 21, further comprising a cabinet, wherein the cabinet is configured to fit underneath the bed when the bed is in a stowed position.

23. The living space of claim 19, further comprising a bed having first and second ends defining a length of the bed, and a cupboard having a front surface and a back surface defining a width of the cupboard, one of the front and back surfaces of the cupboard positioned adjacent one of the first and second ends of the bed, wherein the minimized footprint of the room is approximately equal to a longitudinal length comprising the length of the bed and the width of the cupboard, and a transverse width comprising a width of the bed.

24. The living space of claim 13, wherein the area is a communal area and the room is a bedroom.

* * * * *